US005564473A

United States Patent [19]

Schaich et al.

[11] Patent Number: 5,564,473

[45] Date of Patent: Oct. 15, 1996

[54] APPARATUS AND METHOD FOR CORRECTING IRREGULARITIES IN A SERIES SHED WEAVING MACHINE

[75] Inventors: Urs Schaich, Eschenbach; Rolf Benz, Gachnang; Marcel Christe; Goran Dokic, both of Rüti, all of Switzerland

[73] Assignee: Sulzer Managment AG, Winterthur, Switzerland

[21] Appl. No.: 451,797

[22] Filed: May 26, 1995

[30] Foreign Application Priority Data

May 30, 1994 [EP] European Pat. Off. ..... 94 810316

[51] Int. Cl.[6] ..... D03D 41/00; D03D 47/36

[52] U.S. Cl. ..... 139/28; 139/450; 139/435.1; 139/116.2; 139/452; 139/436

[58] Field of Search ..... 139/28, 450, 435.1, 139/116.2, 452, 436

[56] References Cited

U.S. PATENT DOCUMENTS

| | | | |
|---|---|---|---|
| 4,664,157 | 5/1987 | Shin | 139/435.1 X |
| 4,858,658 | 8/1989 | Shaw | 139/450 X |
| 5,012,844 | 5/1991 | Griffith | 139/116.2 X |
| 5,069,395 | 12/1991 | Krumm | 139/452 X |
| 5,103,876 | 4/1992 | Benz et al. | 139/452 |
| 5,154,209 | 10/1992 | Takegawa | 139/452 |

FOREIGN PATENT DOCUMENTS

| | | |
|---|---|---|
| 0445489A1 | 9/1991 | European Pat. Off. . |
| 0477877A1 | 4/1992 | European Pat. Off. . |
| 0559621A1 | 9/1993 | European Pat. Off. . |

*Primary Examiner*—Andy Falik

*Attorney, Agent, or Firm*—Townsend and Townsend and Crew LLP

[57] ABSTRACT

An apparatus and method for correcting an irregularity during the insertion of a weft yarn into a weaving rotor of a series shed weaving machine involves drawing a length of weft yarn from a supply unit and delivering the weft yarn to the weaving machine in synchronicity with the weaving cycle. The length of weft yarn is inserted into a weft yarn conveyor apparatus and wound around a conveyor roller. A sensor is positioned between the supply unit and the conveyor apparatus to detect a weft yarn interruption, e.g., as a result of a weft yarn breakage or the yarn running out of spool. When the interruption is detected, the conveyor roller continues to deliver weft yarn stored in the storage apparatus until a complete weft yarn insertion into the weaving machine has taken place (i.e., weft yarn having a single loom width). The weft yarn is then cut at the insertion side of the weaving machine and the weaving machine is stopped. The weft yarn remaining in the weft preparation unit is then pulled back by the conveyor roller and discharged into a waste container.

23 Claims, 15 Drawing Sheets

APPARATUS AND METHOD FOR CORRECTING IRREGULARITIES IN A SERIES SHED WEAVING MACHINE

BACKGROUND OF THE INVENTION

The invention relates to an apparatus as well as a method for remedying irregularities which occur during the insertion of a weft yarn into a weaving rotor of a series shed weaving machine. In particular for remedying irregularities due to weft yarn breakages, weft yarns which have been incompletely inserted into the shed and damaged weft yarns. The invention further relates to a series shed weaving machine having an apparatus in accordance with the invention. The invention further relates to a series shed weaving machine operated in accordance with the method of the invention.

It is known to use a metering apparatus for the weft yarn insertion into a series shed weaving machine. A metering apparatus for delivering weft yarn to a series shed weaving machine is known from EP 0 445 489 A1 in which a metering roller pulls off the weft yarn from a yarn supply positioned before it and which feeds this weft yarn to a weaving machine. The metering roller here is wound around with weft yarns many times in order to provide a sufficiently large frictional retention so that the pull-off or draw-off speed and the conveying speed of the weft yarn is determined by the rotational speed of the metering roller. This known metering apparatus is additionally able to provide an automatic threading-in of the weft yarn when loading a new supply spool or bobbin and can automatically bring the weft yarn into a starting position which is advantageous for the weaving.

The known metering apparatus has the disadvantage that, when an irregularity occurs during the weft yarn insertion, for example when a yarn breakage occurs or when the weft yarn is not fully inserted into the shed, the weaving process has to be interrupted and the weft yarn removed by hand from the yarn path or from the shed. Remedying the irregularity requires manual intervention by the operating staff and results in prolonged downtimes of the weaving machine.

SUMMARY OF THE INVENTION

The object of the invention is to provide an apparatus as well as a method for the delivery of weft yarns to the weaving rotor of a series shed weaving machine which avoid the named disadvantages and which, in particular, allow interruptions of the weaving process caused by an irregularity in the weft insertion to be remedied automatically.

The apparatus of the present invention serves as a metering apparatus for drawing a length of weft yarn from a supply unit and fo delivering the weft yarn to the series shed weaving machine in synchronicity with the weaving cycle. The length of weft yarn is inserted into a weft yarn conveyor apparatus and wound around a conveyor roller. A sensor is positioned between the supply unit and the conveyor apparatus to detect a weft yarn interruption, e.g., as a result of a weft yarn breakage or the yarn running out of spool. When the interruption is detected, the conveyor roller continues to deliver weft yarn stored in the storage apparatus until a complete weft yarn insertion into the weaving machine has taken place (i.e., weft yarn having a single loom width). The weft yarn is then cut at the insertion side of the weaving machine and the weaving machine is stopped. The weft yarn remaining in the weft preparation unit is then pulled back by the conveyor roller and discharged into a waste container.

The advantages of the invention are that the uptime of a weaving machine increases when particular kinds of interruptions in the weaving process can be remedied automatically, for example interruptions due to a spool change, a weft yarn breakage or a weft yarn which has not been fully inserted into the shed. An advantage of the invention is that a yarn storage means for the weft yarn is placed before the metering apparatus or that the metering apparatus simultaneously serves as the yarn storage means, wherein the length of yarn stored corresponds to at least one loom width so that when a weft yarn breakage occurs between the metering roller and the spool or when a weft yarn end of a spool arises (spool becomes empty) the weft yarn can still be fully inserted into the shed before the weaving process has to be interrupted. A further advantage is that the metering apparatus can be driven in a direction opposite to the weft yarn insertion direction which makes it possible to automatically pull back and dispose of a weft yarn which has not yet been fully inserted into the shed, i.e. a weft yarn which has not yet been cut at the weft insertion side.

BRIEF DESCRIPTIONS OF THE DRAWINGS

The invention is described in the following with the aid of embodiments which show:

FIG. 1*a* a schematic arrangement of a metering apparatus of the invention with the weft yarn inserted and with a conveyor roller with yarn wound around it;

FIG. 1*b* plan view onto the conveyor roller with weft yarn wound around it in an apparatus in accordance with FIG. 1*a;*

FIG. 1*c* section through a conveyor roller of the arrangement of FIG. 1*b;*

FIG. 1*d* schematic arrangement of a further embodiment of an apparatus in accordance with the invention;

FIG. 2*a* schematic arrangement of a separation and deflection apparatus;

FIG. 2*b*–2*e* embodiment of a separation and deflection apparatus;

FIG. 2*f*–2*l* representation of different method steps for operating the separation and deflection apparatus;

FIG. 3*a* plan view of a yarn brake in an apparatus in accordance with FIG. 1*a;*

FIG. 3*b* side view of a yarn brake in accordance with FIG. 3*a;*

FIG. 4 schematic view of a weft yarn insertion into a series shed weaving machine;

FIG. 5*a*–5*c* method for remedying irregularities;

FIG. 6*a*–6*d* method for remedying irregularities.

DESCRIPTION OF SPECIFIC EMBODIMENTS

Figures 1A, 1B:
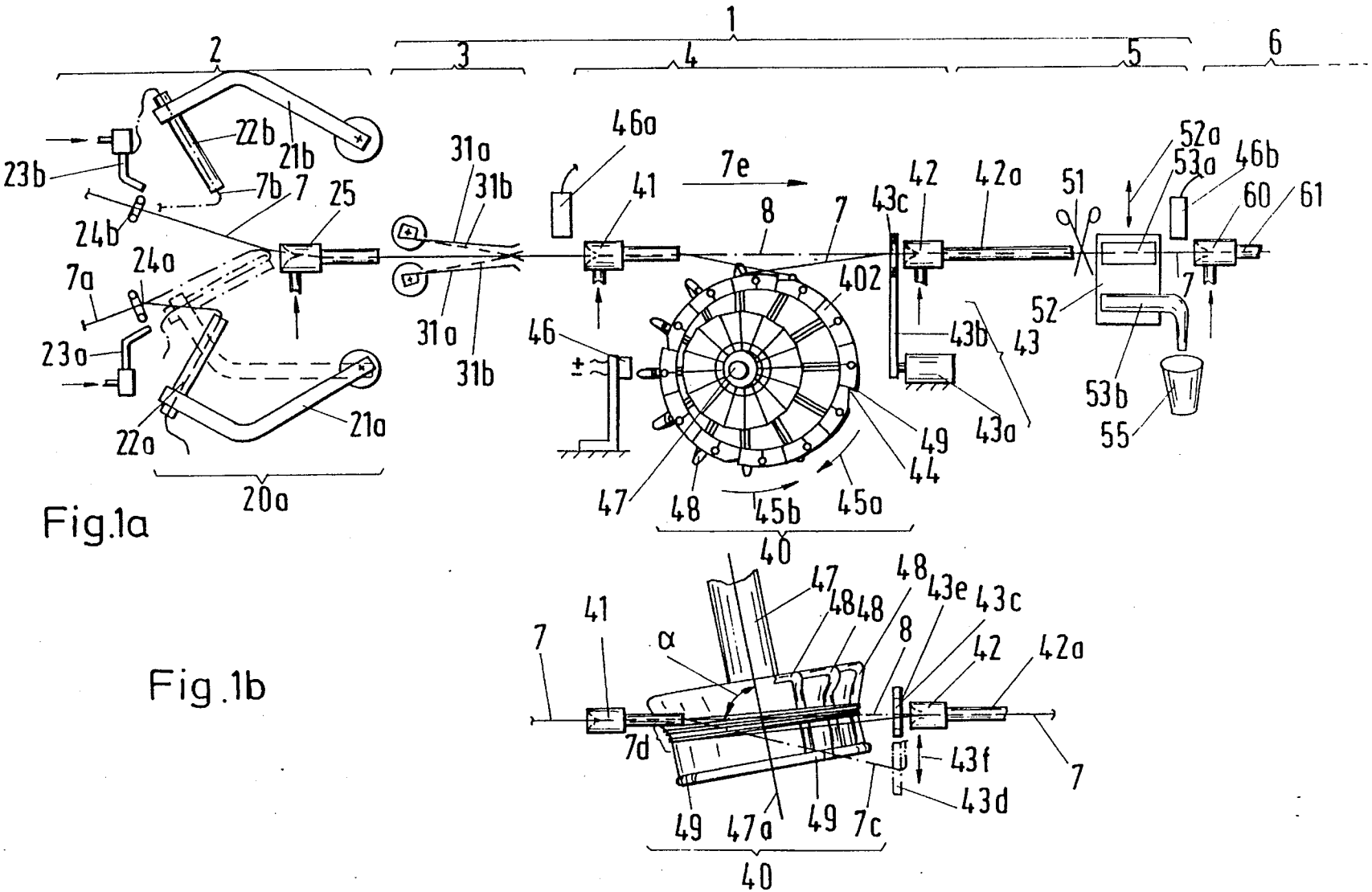

FIG. 1 shows an apparatus 1 for remedying irregularities which occur during the insertion of a weft yarn into a weaving rotor of a series shed weaving machine. The apparatus serves in particular as a metering apparatus 1 or, alternatively, an insertion error-correction apparatus 1 for pulling off a weft yarn 7 from a supply unit 2 and for delivering it to the weaving machine synchronized to the weaving cycle. The supply unit 2 pulls off the weft yarn 7 from a spool or bobbin (not shown) and guides it via an eyelet 24*b* to a suction nozzle 25 which is supplied with a fluid. The supply unit 2 comprises one or more weft yarn supply apparatuses 20*a* which hold the ends of the weft yarns 7*a* and 7*b* of further spools ready. The weft yarn 7*a* which is being held ready runs through the eyelet 24*a* and is pivotably held via a pivot arm 21*a* in the weft yarn holder tube 22*a*. When supply of the weft yarn 7*a* to the weaving machine is required, the pivot arm 21*a* is pivoted into the position shown by the dashed lines and the weft yarn holder tube 22*a* is supplied with a fluid from the insertion nozzle 23*a* so that the weft yarn 7*a* is captured by the suction nozzle 25 and inserted into the following units of the metering apparatus 1. A further weft yarn 7*b* can be held ready in exactly the same way with further weft yarn supply apparatuses 20*a* such as the pivot arm 21*b* with weft yarn holder tube 22*b* and insertion nozzle 23*b*. The suction nozzle 25 conveys the weft yarn 7 through an opened yarn brake 3 to a weft yarn conveyor apparatus 4 having an insertion nozzle 41. In the present embodiment, the weft yarn brake 3 is formed out of two pivotable guide surfaces 31*a* which, in their closed state 31*b*, contact one another and thus exert a clamping and braking effect onto the weft yarn 7. When a yarn tip of a weft yarn 7 is conveyed from the suction nozzle 25 through the yarn brake 3 in the direction of the insertion nozzle 41, the guide surfaces 31*a* which are in an opened position can additionally influence the flight trajectory of the weft yarn 7 towards the insertion nozzle 41.

The weft yarn conveyor apparatus 4 that follows has the role of conveying the weft yarn 7 in the weft insertion direction 7*e* and also of conveying it opposite to this insertion direction. The insertion nozzle 41 and a catcher nozzle 42 lying opposite in the weft insertion direction 7*e* define an insertion axis 8 along which a weft yarn 7 is inserted into the weft yarn conveyor apparatus 4. A guide apparatus 43 is arranged directly in front of the catcher nozzle 42 and comprises a drive apparatus 43*a*, a pivot arm 43*b* and an eyelet 43*c*. When a new weft yarn tip of a weft yarn 7 is inserted, the eyelet 43*c* lies in the insertion axis 8 so that the weft yarn 7 is carried through the eyelet 43*c* and from there into the catcher nozzle 42. It then penetrates further into the conveyor channel 42*a*.

Figure 4:
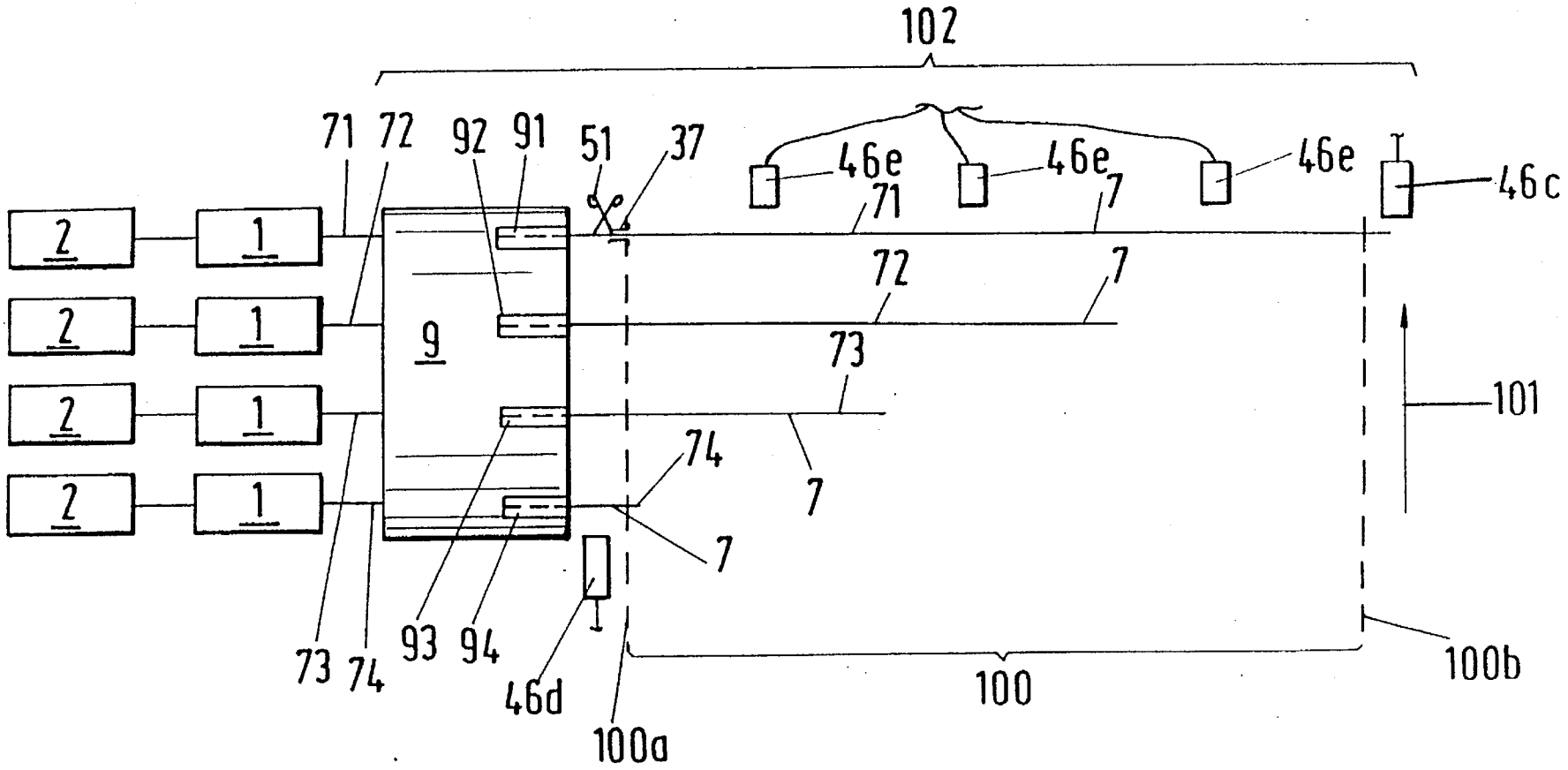

The weft yarn conveyor apparatus 4 has a conveyor roller 40 between the insertion nozzle 41 and the catcher nozzle 42 and has a support surface in the peripheral direction on which the weft yarn 7 lies. In conveying operation, the weft yarn 7 is wound around the support surface many times. In the present embodiment, the support surface is formed by support elements 48 which are regularly spaced relative to one another in the direction of rotation. The ends of the support elements 48 merge into a rim element 402 which has one or more catcher noses 49 on its outer periphery which are separated from one another and form a catcher region 44. The conveyor roller 40 is both rotatable in a rotation direction 45*a* for supplying a weft yarn 7 to a weft preparation unit 6 and also rotatable in a rotational direction 45*b* for pulling a weft yarn 7 back out of the weft preparation unit 6. The individual windings of the weft yarn 7 normally lie next to each other on the support surface of the conveyor roller 40 so that the stored length of the weft yarn supply can be determined and monitored with an optical sensor 46 via the measurement of the width of the stored weft yarn 7 wound on. A separation and deflection apparatus 5 follows after the weft yarn conveyor apparatus 4 in the weft insertion direction 7*e* and comprises a weft yarn cutting apparatus 51 and a deflection apparatus 52. The deflection apparatus 52 can be moved to and fro in the movement direction 52*a* with a drive apparatus so that either a conveyor channel 53*a* is placed in the insertion axis 8 in order to guide a weft yarn 7 which is to be inserted into the weft preparation unit 6 following thereafter, or a bent-over conveyor channel 53*b* is placed in the insertion axis 8 in order to supply a weft yarn 7 being conveyed in the weft insertion direction 7*e* to a waste container 55. A weft preparation unit 6 follows after the separation and deflection apparatus 5 in the direction of the insertion axis 8, with a transport nozzle 60 and a conveyor channel 61 being shown. The conveyor channel 61 opens out into a weft yarn distribution apparatus 9 which guides the weft yarn 7 to an opened shed of a series shed weaving machine (FIG. 4). The insertion axis 8 advantageously extends from the suction nozzle 25 up to the transport nozzle 60.

FIG. 1*b* shows a plan view onto the conveyor roller 40 of the weft yarn conveyor apparatus 4. The insertion axis 8 is at an angle of inclination alpha relative to the rotatable axle 47 of the conveyor roller 40 and has a minimum separation from the support surface of the conveyor roller 40. The minimum separation from the support surface for the weft yarn 7 is designed such that the fluid stream from the insertion nozzle 41 is only insubstantially deflected by the elements 48 forming the support surface. The sequence of events for automatically winding on the weft yarn 7 onto the conveyor roller 40 is described in relation to the arrangement of FIG. 1*b*. A weft yarn 7 is carried from the insertion nozzle 41, along the insertion axis 8, through the eyelet 43*c* positioned in front of the guide apparatus 43 and subsequently into the opening of the catcher nozzle 42 and then runs further through the conveyor channel 42*a*. During insertion the bent-over or angled conveyor channel 53*b* normally lies in the insertion axis 8 so that the weft yarn 7 being inserted passes into the waste container 55. After successful insertion into the weft yarn conveyor apparatus 4, the catcher nozzle 42 continues to be actuated by a fluid and exerts a force on the weft yarn 7 acting in the weft insertion direction 7*e*. The pivot arm of the guide apparatus 43 is brought from an insertion position 43*e* into a winding-on position 43*d* via a movement in the pivotal direction 43*f*. The weft yarn 7 thus comes into contact with the rim elements 402 so that the weft yarn 7 passes into a catcher region 44 as a result of the rotation in the rotational direction 45*a* of the conveyor roller 40 and is held by a catcher nose 49 so that, as the conveyor roller 40 rotates further, an increasing amount of weft yarn 7 is wound onto the support surface of the conveyor roller 40 thus forming a wound-on weft yarn 7*d*. As soon as the desired number of windings of the weft yarn 7 is present on the support surface of the conveyor roller 40, the winding-on process is stopped and the guide apparatus 43 moved from the winding-on position 43*d* into the insertion position 43*e*. The weft yarn 7 is thus removed from the catcher nose 49 and the conveyor roller 40 is then ready to convey the weft yarn 7. The support surface of the conveyor roller 40 is designed in such a way that a large number of windings of the weft yarn 7 can be accommodated. The conveyor roller 40 thus simultaneously performs the function of a yarn storage means, wherein the length of thread stored on the conveyor roller corresponds to at least one loom width, i.e. the width of one weft insertion of the weaving machine following on.

Figure 1C:
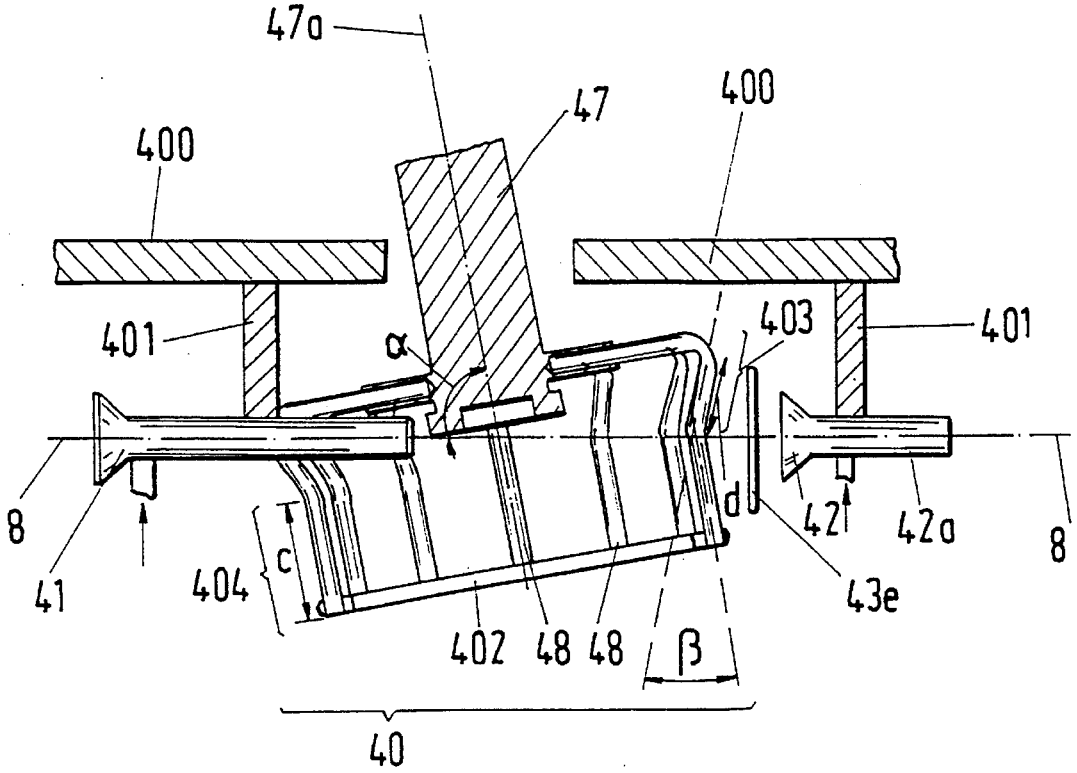

FIG. 1*c* shows a further plan view of the weft yarn conveyor apparatus 4 with conveyor roller 40. The insertion nozzle 41 and catcher nozzle 42 are held by the carrier elements 400, 401 and define the insertion axis 8. The center of rotation 47*a* of the rotatable axle 47 of the conveyor roller 40 is at an angle alpha relative to the insertion axis 8, this angle being less than 90 degrees. The size of the angle alpha depends on the design of the support surface of the conveyor roller 40 as well as on the length, i.e. the number of windings, and thickness of the weft yarn 7 which is to be stored on the conveyor roller 40. The support surface of the conveyor roller 40 comprises a conical region 403 which tapers over a width 'd' starting from the side of the rotatable axle 47 towards the rim element 402 and extends into a region 404 of width c which extends approximately parallel to the center of rotation 47*a*. The widths c and d of the regions 403 and 404 as well as the angle of inclination beta between the regions 403 and 404 depend, among other things, on the length and nature of the weft yarn 7 which is to be stored. If the conveyor roller 40 conveys the weft yarn 7 in the direction of rotation 45*a*, i.e. in the weft insertion direction 7*e*, the part of the weft yarn 7 which is at the front relative to the weft insertion direction 7*e* is continuously pulled from the support surface of the conveyor roller 40 and guided further via the catcher nozzle 42 into the separation and deflection apparatus 5. When doing this, it is desirable that the individual windings of the wound-on weft yarn 7*d* lie next to one another in such a way that they don't cross over each other, that the weft yarn 7 subsequently delivered from the supply unit is placed onto the conical part 403 and that the pulled-off weft yarn 7 is placed in the cylindrical part 404 adjacent to the rim element 402. During conveying operation in the rotational direction 45*a*, the individual windings of the weft yarn 7 thus glide on the support surface in the direction of the rotational axis 47*a* towards the rim element 402 before the winding is lifted off once more and the weft yarn 7 guided further through the catcher nozzle 42. If possible, slippage in the direction of rotation 45*a* between the windings of the weft yarn 7 and the support surface of the conveyor roller 40 is to be avoided. The conveyor roller 40 thus also serves as a metering or dosing apparatus for the weft yarn 7 since the length of weft yarn 7 conveyed can be determined on the basis of the number of rotations of the conveyor roller 40. The jacket surface of the support surface should therefore exert a sufficiently large static friction in the direction of rotation 45*a*, 45*b* on the stored weft yarn 7 in order to avoid slippage in the direction of rotation. At the same time, the frictional adhesion in the direction 47*a* of the rotational axis should be relatively small so that the individual windings of the weft yarn 7 slide in the direction 47*a* on the support surface. The individual windings of the weft yarn 7 lie close up to one another, in particular during conveyance operation in the direction of rotation 45*a*. During this, the windings lie in the conical region 403 and exert a force acting towards the rim element 402 in the direction 47*a* so that the windings lying in the region 404 are continually pushed in the direction of the rim element 402. The sliding or dynamic friction between the weft yarn 7 and the support surface in the region 404 is advantageously selected so that the individual windings remain lying next to one another and are not pushed over each other.

The design of the shape and form of the support surface of the conveyor roller 40 as well as its surface properties are of central importance for allowing the storage of a larger number of windings of weft yarn 7 in such a way that, during conveyance operation, the weft yarn 7 can be freely pulled off once more and in such a way that the conveyor roller 40 also serves as a metering apparatus for determining the length of the weft yarn 7 inserted. These conditions can be achieved with a large number of embodiments of the conveyor roller 40, the particular embodiment chosen depending strongly on the quality and on the properties of the weft yarn 7 used. In the present embodiment, the support surface of the conveyor roller 40 is formed by support elements 48 which are regularly spaced in the rotational direction 45*a*. This embodiment of the conveyor roller 40 provides a small static and sliding friction on the weft yarn 7 lying thereon for movements in the direction of the rotational axis 45*a*, as well as a sufficiently large static friction in the direction of rotation 45*a*. It can however be advantageous, independently of the properties of the weft yarn 7, to implement the support surface of the conveyor roller 40 as a fully closed jacket surface or, for example, to provide the jacket surface in some positions with perforations. The behaviour of the weft yarn 7 on the conveyor roller 40 is further influenced by a suitable choice of the angles alpha and beta and through the widths c and d of the regions 403 and 404.

The steps of a method for automatic threading and or automatic remedying of irregularities is explained in more detail with the arrangement in accordance with FIG. 1*a*.

In order to thread in a weft yarn 7, the weft yarn is initially placed in front of the suction nozzle 25, the yarn brake 3 is opened, the fluid nozzles 25, 41 and 42 thereupon activated and the weft yarn 7 inserted into the separation and deflection apparatus 5 via the yarn brake 3 and the weft yarn conveyor apparatus 4. It is usual for the bent-over conveyor channel 53*b* to lie in the insertion axis 8 during the threading-in process so that the weft yarn tip, and in some cases a further weft yarn 7, pass into the waste container 55. Subsequently, only the fluid nozzle 42 remains activated, the pivot arm 43*b* of the guide apparatus 43 is brought into the winding-on position 43*d*, the conveyor roller 40 starts to rotate in the rotational direction 45*a* and the support surface of the conveyor roller 40 is provided with the required number of windings. During this, the weft yarn 7 remains substantially held by the catcher nozzle 42 so that the weft yarn 7 continues to be delivered from the supply unit 2 during the winding-on process. As soon as the conveyor roller 40 is provided with a predetermined number of windings, the guide apparatus 43 is brought into the insertion position, the weft yarn 7 is cut by the weft yarn cutting apparatus 51 and the conveyor channel 53*a* of the guide apparatus 52 is brought into the insertion axis 8. The conveyor roller 40 then begins to rotate in the rotational direction 45*a* and the weft yarn 7 is supplied to the weaving machine via the weft preparation unit 6. The conveyor roller 40 therefore determines the speed of the weft yarn 7 in the weft insertion direction 7*e* and synchronizes the weft yarn insertion into the weft preparation unit 6 with the weaving cycle of the weaving machine. It is advantageous to supply the weft yarn 7 continuously to the weft preparation unit 6.

If a weft yarn interruption now occurs between a spool of the supply unit 2 and the weft yarn conveyor apparatus 4, for example, caused by a weft yarn breakage or by the end of the yarn of a spool, this is determined with the aid of a sensor 46. The sensor 46 determines that the width of the weft yarn 7*d* which is wound on has fallen below an adjustable minimum value. As soon as a weft yarn interruption is established, the conveyor roller 40 continues to deliver the weft yarn 7 stored on the conveyor roller 40 until a complete weft insertion over the full width of the weaving machine has taken place. The weft yarn 7 is then cut at the insertion-side end of the weaving machine and the weaving machine is stopped. Since the width of the wound-on weft yarn 7*d* has reduced, the end of the weft yarn 7 must lie on the conveyor roller 40. The weft yarn 7 which remains in the weft preparation unit 6 is pulled back by the conveyor roller 40 which now rotates in the rotational direction 45*b* until the weft yarn tip is behind the weft yarn cutting apparatus 51. The guide apparatus 52 is then switched to place the conveyor channel 53*b* in the insertion axis 8. The conveyor roller 40 then rotates in the rotational direction 45*a* and the remaining weft yarn 7 is conveyed into the waste container 55. The metering apparatus is thus freed from thread waste and is ready for a new, automatic threading-in process.

As soon as the sensor 46 determines that the width of the weft yarn 7*d* stored on the conveyor roller 40 has fallen below an adjustable minimum value, the following procedure can also be adopted. The weaving machine is stopped without yet having cut the weft yarn on the insertion side. The conveyor roller 40 is then actuated in the rotational direction 45*b*. The weft yarn 7 situated in the shed is then pulled back and temporarily stored on the conveyor roller 40. As soon as the weft yarn tip has been pulled back as far as the weft yarn cutting apparatus 51, the guide apparatus 52 is switched and the weft yarn 7 situated on the conveyor roller 40 is disposed of into the waste container 55 whereupon a new weft yarn 7 is automatically threaded in using the method already described.

Figure 1D:
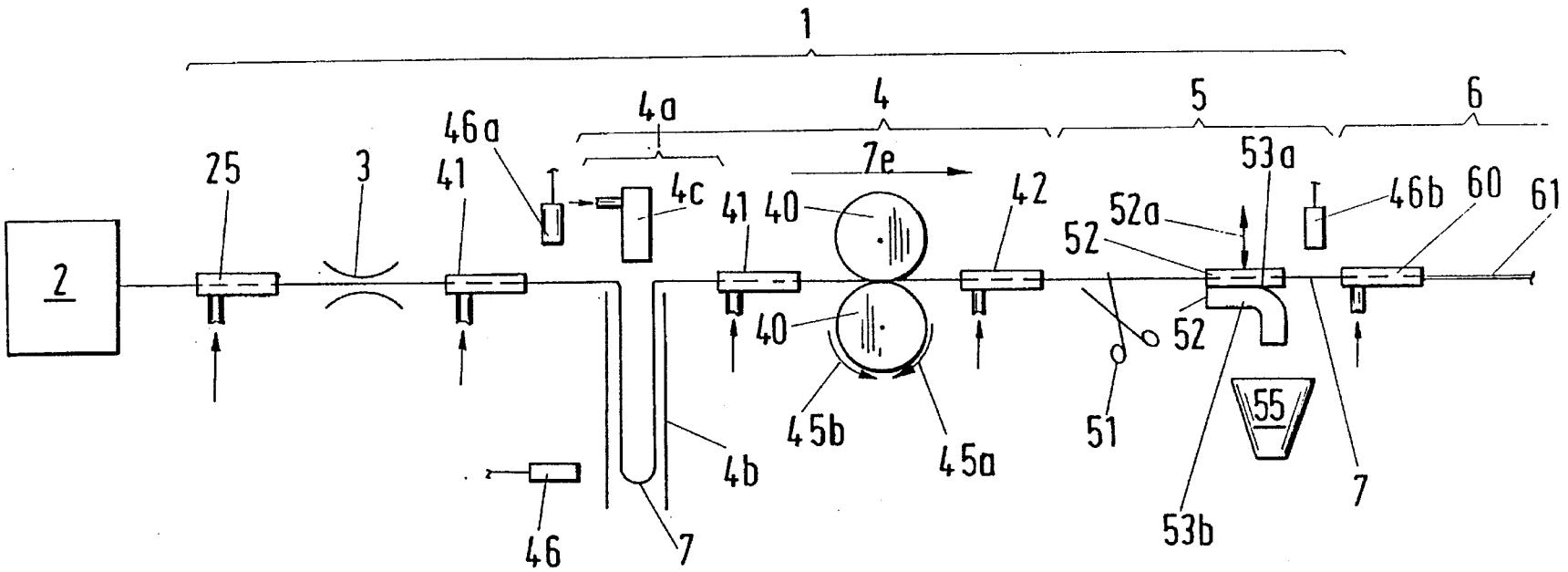

In contrast to the embodiment shown in FIG. 1*a*, the metering apparatus shown in FIG. 1*d* has a weft yarn conveyor apparatus 4 and a weft yarn storage means 4*a* disposed before it in the yarn running direction 7*e*. The storage apparatus 4*b* is formed as a tube with a fluid nozzle 4*c* arranged above the upper tube opening which allows the weft yarn 7 to dip or dunk into the storage apparatus 4*b* and with a sensor 46 which determines the length of yarn stored. The weft yarn conveyor apparatus 4 following after the weft yarn storage means 4*a* determines the conveyance direction of the weft yarn 7. This is performed by using two counter-rotating conveyor rollers 40 to lightly clamp the weft yarn 7 in such a manner that, if possible, slippage between the conveyor roller 40 and weft yarn 7 is avoided so that the inserted length of weft yarn 7 can be determined from the number of rotations of a conveyor roller 40. Otherwise, the points already made in relation to FIG. 1*a* are also valid for this embodiment. A length of yarn is advantageously stored in the storage apparatus 4b which corresponds to one to two loom widths of the weaving machine following afterwards. When pulling the weft yarn 7 back by actuating the conveyor roller 40 in the rotational direction 45*b*, it is advantageous to supply a fluid to the insertion nozzle 41 lying between the conveyor roller 40 and the storage apparatus 4*b* in such a manner that the insertion nozzle 41 conveys the weft yarn 7 opposite to the weft insertion direction 7*e* in the direction of the storage apparatus 4*b*.

In FIG. 1*a* and FIG. 1*d*, three sensors 46, 46*a* and 46*b* for monitoring the weft yarn 7 are shown. The sensor 46 would however be sufficient on its own for operation of the entire metering apparatus 1.

As already described, the weft yarn 7 is cut by the separation and deflection apparatus 5 on its insertion thus producing a weft yarn tip with an exactly defined position. If the conveyor roller 40 is provided with a sensor for detecting the rotational angle, the current position of the weft yarn tip can be determined exactly since the position at the time of cutting is well defined and the path lengths in a weft insertion apparatus are known quantities. The weft yarn tip can thus be conveyed into an exactly defined positions. If a weft yarn breakage occurs, the weft yarn 7 at the weaving machine is cut, for example at the weft insertion side, whereby a weft yarn tip with an exactly defined position is produced once again. The metering apparatus 1 subsequently pulls back the weft yarn 7 out of the weft preparation unit 6, with the length of weft yarn 7 which has been pulled back being determinable via the rotation of the conveyor apparatus 40 so that the weft yarn tip can be positioned exactly, for example in front of the separation and deflection apparatus 5.

The schematic embodiment shown in FIG. 2 of a separation and deflection apparatus 5 has a conveyor channel 42*a*. A weft yarn 7 is moved through the conveyor channel 42*a* conveyed by a fluid stream to the outlet opening 42*b*. Two conveyor channels 53*a*, 53*b* with inlet or entrance openings 53*c*, 53*d* are also shown through which the weft yarn 7 can be conveyed further. An inlet opening 53*c*, 53*d* is arranged approximately opposite to the outlet opening 42*b* in order to receive a weft yarn 7 and is termed as a positioned inlet opening 57. The outlet opening 52*b* and the positioned inlet opening 57 for receiving the weft yarn 7 are separated by a distance 57*a* of width S. The fluid being emitted from the outlet opening 52*b* forms a free fluid stream 54*a* in the intermediate volume 57*a* with a principle flow direction 54*b*. The outlet opening 52*b* of the conveyor channel 42*a* and, at any one time, one of the inlet openings 53*c*, 53*d* are displaced relative to one another so that when a weft yarn 7 is emitted from the outlet opening 52*b* it is influenced by the free fluid stream 54*a* and passes into the positioned inlet opening 57 which is currently available. A part of the free fluid flow 54*a* also passes into the conveyor channel 53*a*, 53*b* via the inlet opening 53*c*, 53*d* and conveys the weft yarn 7 through the respective conveyor channel 53*a*, 53*b*. The width S of the system 57*a* is at the least selected so that the cutting parts 51*b*, 51*c* of a cutting apparatus 51 can pass into the gap or slit 57*a* in order to cut through a weft yarn 7 situated there. From a large number of cutting apparatuses 51 which could be used in the separation and deflection apparatus 5 of the invention, the present embodiment uses a scissor-like cutting apparatus 51 with two cutting surfaces 51*b*, 51*c* which cross one another. Scissor-like cutting apparatuses 51 usually have cutting surfaces which are slightly skewed relative to one another so that a point-like cutting point results. A pair of scissors of this kind has a relatively large cutting force so that differing weft yarns 7, weft yarns 7 which are difficult to cut and very thin weft yarns 7 can be cut unproblematically. A further advantage of scissors 51 of this kind is that the amount of dirtying which occurs remains small since no contacting surfaces are present and the dirt can be carried away by the free fluid flow 54*a*. The actuation of the cutting apparatus 51 is performed via a drive apparatus 51*a*.

The delivering conveyor channel 42*a* and the two receiving conveyor channels 53*a*, 53*b* must be displaceable relative to one another. In the current embodiment, two conveyor channels 53*a*, 53*b* are held together by a holder 56 which is displaceable in the direction of movement 52*a* and can be displaced by a drive apparatus 56*a*. Completely different directions of movement 52*a* are possible, e.g. among others circular movement, in order to move an inlet opening 53*c*, 53*d* into the position of a positioned inlet opening 57.

The minimum separation of the gap 57*a* between the outlet opening 42*b* and the positioned inlet opening 57 is given by the dimension of the cutting parts 51*b*, 51*c* of the cutting apparatus 51. The slit width S can however be chosen to be larger with, for example, the slit width being individually adjustable for each conveyor channel 53*a*, 53*b* by making the conveyor channels 53*a*, 53*b*, 42*a* movable to and fro in the displacement direction 53*e*, 53*f*, 42*c* and thus allowing different slit widths S1, S2 to be achieved. The amount of free fluid flow 54*a* which passes into the positioned inlet opening 57 and then flows further through the adjoining conveyor channel 53*a*, 53*b* is dependent on the distance S. By adjusting the distance S, the relative amount of fluid in the following conveyor channel 53*a*, 53*b* or the fluid loss in the slit S can be adjusted. The fluid loss in slit S can contribute substantially to keeping the surroundings of the inlet opening 53*c*, 53*d* clean since the fluid loss flows outwardly and conveys dirt or dust particles away.

The separation and deflection apparatus 5 can be adjusted to take account of weft yarns having the most different properties by making use of the possibilities available for varying the slit width S. For example, thin yarns have the property that when they emerge from the outlet opening 42*b* the weft yarn tip can lie in a larger possible area so that the slit width S can be adjusted to be small to ensure a reliable threading in into the positioned inlet opening 57.

The inlet and outlet openings 42*b*, 53*c*, 53*d* and the conveyor channels 42*a*, 53*a*, 53*b* can have different cross-sectional areas so that it is possible to influence the amount of air transmitted and to provide a reliable threading-in of the weft yarn into the inlet opening 57 by adjusting the cross-sectional area.

In the current embodiment, only two outgoing conveyor channels 53*a*, 53*b* are shown. The apparatus of the invention is however simple to scale up so that each of a large number of outgoing conveyor channels 53*a*, 53*b* can be brought into alignment with a positioned inlet opening 57. It is thus possible to switch a large number of conveyor channels 53*a*, 53*b*.

FIGS. 2*b*–2*e* each show the same side view of an embodiment of a separation and deflection apparatus in which the weft yarn cutting apparatus 51 and the deflection apparatus 52 are driven by a common drive apparatus 56*a*.

Figure 2A:
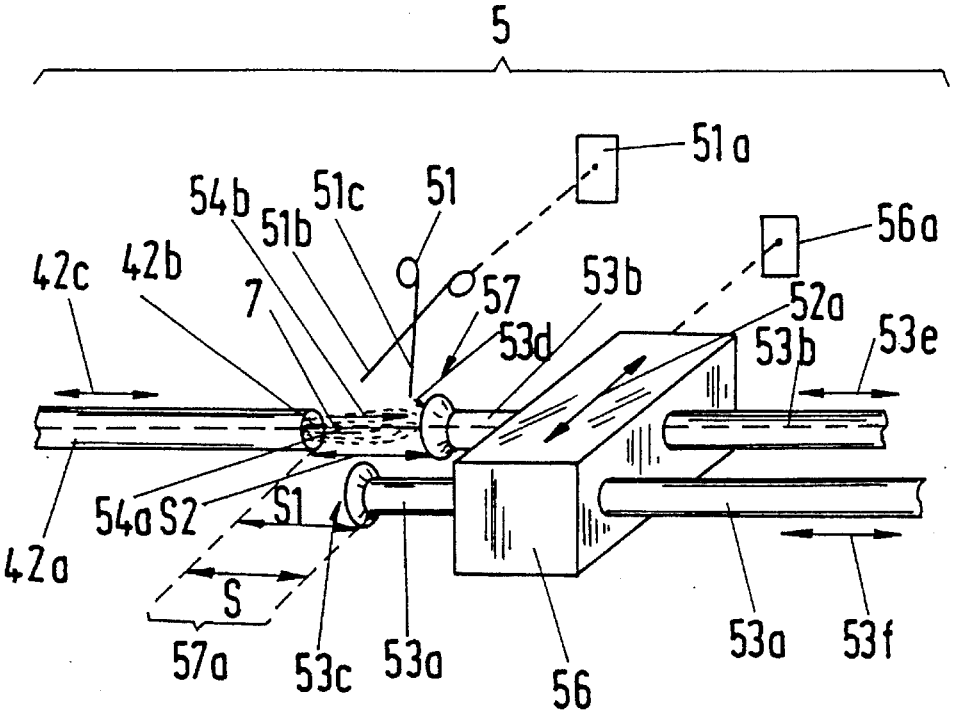
Figure 2B:
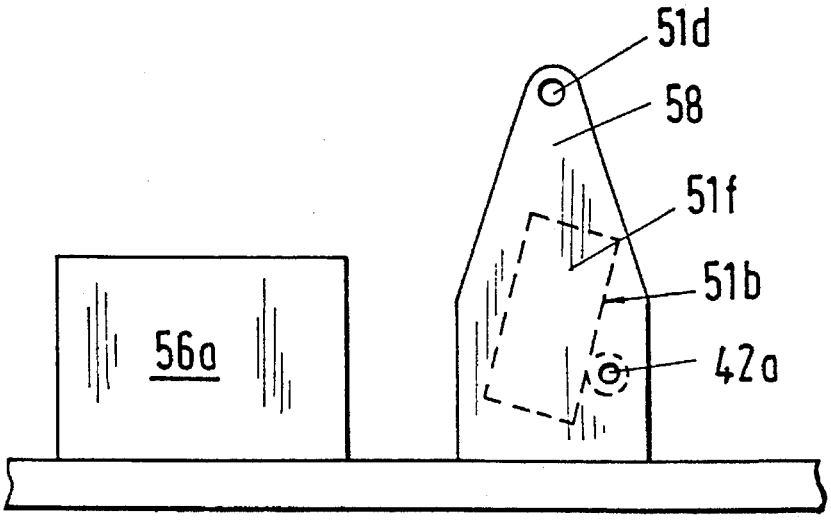

In FIG. 2*b*, a drive apparatus 56*a* is shown which is rigidly connected to a holder apparatus 58. The holder apparatus 58 comprises a rigidly connected blade 51*f* with a cutting surface 51*b* and an opening for a conveyor channel 42*a* and a bore 51*d* for accommodating a pivot axle of the cutting apparatus.

Figure 2C:
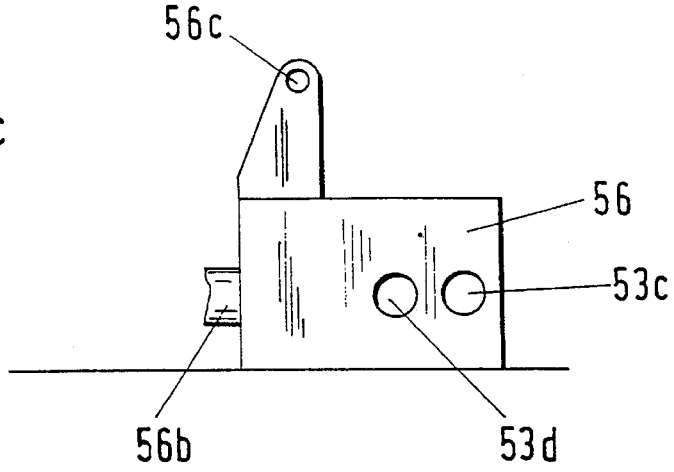

FIG. 2*c* shows a movable holder 56 for the two conveyor channels 53*c*, 53*d*. The holder 56 further comprises a connection element 56*d* to the drive apparatus 56*a* and a connection element 56*c* to the blade 51*g* with the cutting surface 51*c*.

Figure 2D:
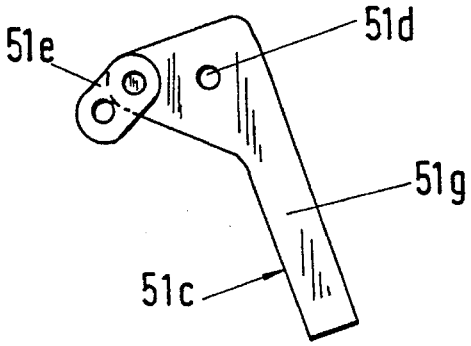

FIG. 2*d* shows the movable blade 51*g* with cutting surface 51*c* and a bore for receiving the pivot axle 51*d* of the blade 51*g*. A pivoted force transmission means 51*e* is also shown which is connected to the movable holder 56 via the connection 56*c*.

Figure 2E:
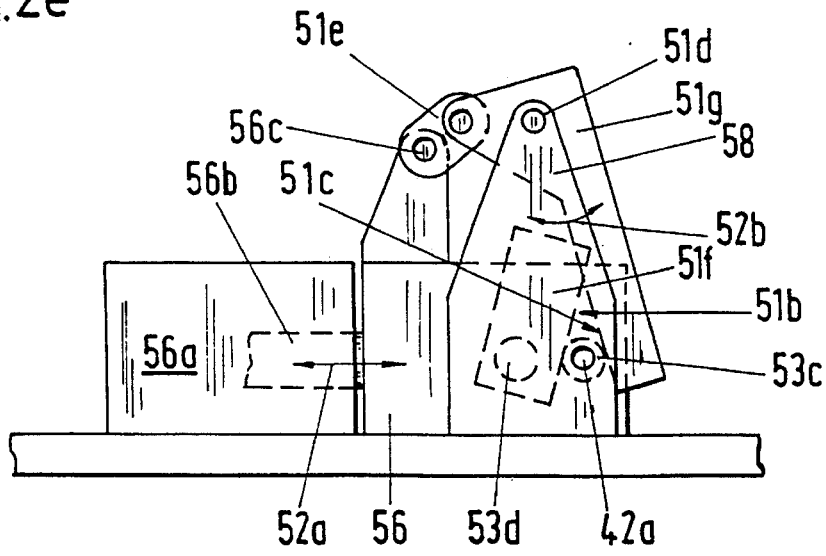

FIG. 2*e* shows the components shown individually in FIGS. 2*b* to 2*d* assembled together in their operational position. The blade 51*g* is connected to the holder apparatus 58 so as to be pivotable in the moving direction 52*b* via the pivot axle 51*d*. Moreover, the blade 51*g* is connected to the holder 56 via the pivotably connected force transmission means 51*e*. The holder 56 is itself connected to the drive apparatus 56*a* via the connection element 56*b* so that the holder 56 can be moved to and fro in the movement direction 52*a* via the drive apparatus 56*a*. In the position shown, the conveyor channel 42*a* and the inlet opening 53*c* of the conveyor channel 53*a* lie opposite to one another. If the holder 56 is switched by using the connection means 56*b* to enlarge the separation to the holder 56, the inlet opening 53*d* of the conveyor channel 53*b* ends up positioned in front of the conveyor channel 42*a*. During the switching process, the blade 51*g* with the cutting surface 51*c* is simultaneously pivoted so that the two cutting surfaces 51*c* and 51*b* cut through a weft yarn 7 situated between them.

Figure 2F:
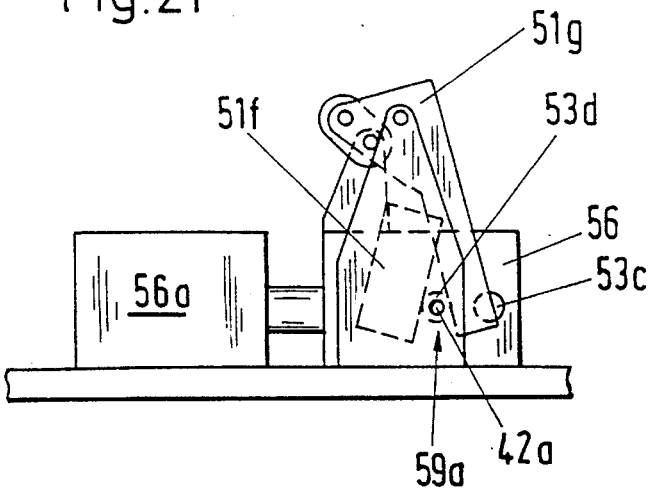
Figure 2I:
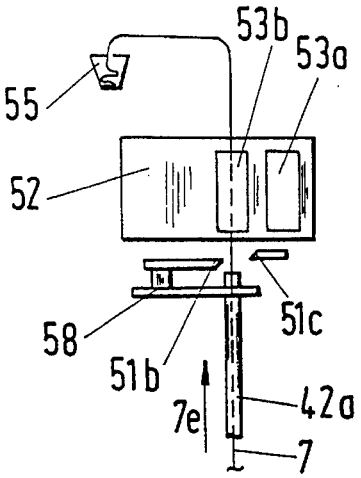
Figure 2G:
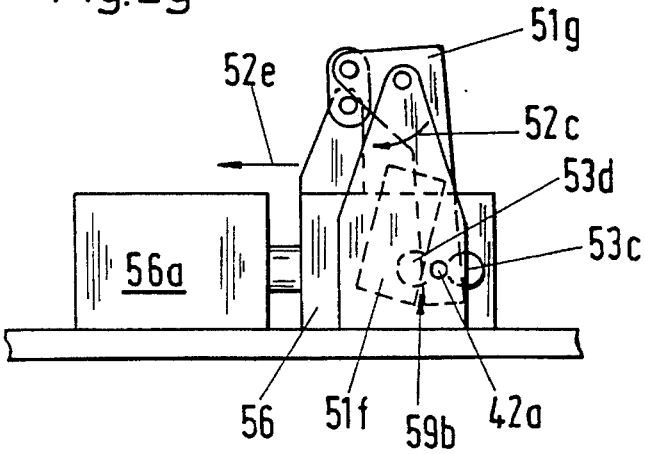
Figure 2K:
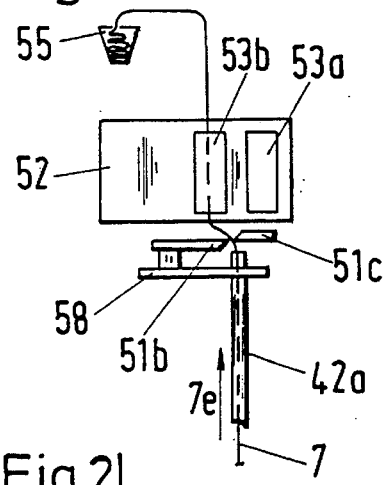
Figure 2H:
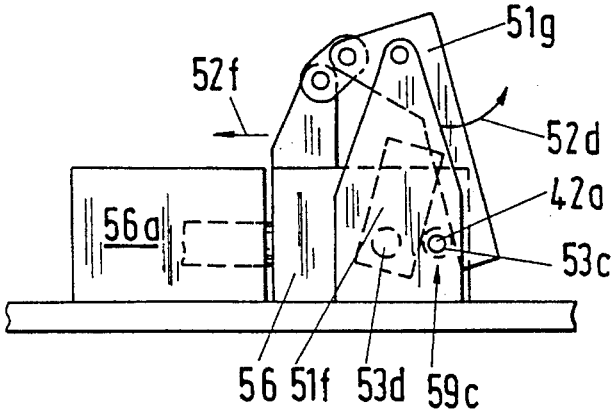

In FIGS. 2*f* to 2*h*, different phases of the cutting and switching process are shown in side view. FIGS. 2*i* to 2*l* show the same phases in plan view.

Figure 2L:
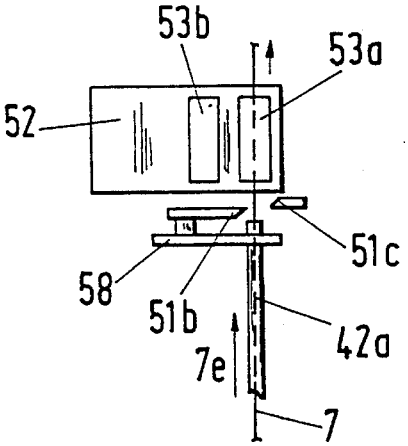

In FIG. 2*i*, the conveyor channels 42*a* and 53*b* are aligned along the insertion axis 8 so that the weft yarn 7 is conveyed into the waste container 55. The side view in FIG. 2*f* shows the conveyor channel 42*a* and the inlet opening 53*d* of the conveyor channel 53*b* which lies opposite. The cutting apparatus 51 with blades 51*f* and 51*g* is in its opened condition 59*a*. During the cutting and switching process, the holder 56 and thus the two inlet openings 53*c* and 53*d* are moved in the direction of movement 52*e* towards the drive apparatus 56*a* as shown in FIG. 2*g*. As a result of the mechanical coupling between the cutting apparatus 51 and the holder 56, the blade 51*g* simultaneously performs a closing pivotable movement 52*c* so that the two blades 51*f* and 51*g* move into a closed condition 59*b* and a weft yarn 7 situated between the cutting surfaces is cut through. The plan view FIG. 2*k* shows the cutting process once more, in particular the two cutting surfaces 51*b*, 51*c* which cut through the weft yarn 7 are shown. If the holder 56 is moved further towards the drive apparatus 56*a* in the direction of movement 52*f*, as is shown in FIG. 2*h* and 2*l*, the cutting and switching process is concluded by the pivotable blade 51*g* forming an opening movement in the direction of movement 52*d* and by the conveyor channel 42*a* being placed opposite the inlet opening 53*c* of the conveyor channel 53*a*. The cutting and switching process can naturally also be performed in the opposite direction by moving the holder 56 in a direction opposite to the direction of movement 52*e*, 52*f* away from the drive apparatus 56*a*. In so doing, the two blades 51*f*, 51*g* also perform a cutting movement and on conclusion of the switching process the inlet opening 53*d* lies once more in position in front of the conveyor channel 42*a*. The separation and deflection apparatus 5 also allows a weft yarn 7 which is continuously transported in the weft insertion direction 7*e* to be cut and switched. In FIG. 2*k*, a continuously supplied weft yarn 7 is cut. It can be seen from FIG. 2*l* how the switching process subsequently comes to an end as the newly formed weft yarn tip is inserted into the conveyor channel 53*a*.

The separation and deflection apparatus 5 shown has the advantage that cutting and switching can take place as the weft yarn 7 is continuously conveyed. Further advantages are that only one drive apparatus is necessary, that the amount of fluid in the conveyor channels 53*a*, 53*b* can be influenced by the variation of the slit width S, that the fluid loss occurring in the slit conveys away dirt or dust particles, that the scissor-like cutting apparatus 51 reliably cuts the most different kinds of yarn and that a cutting movement takes place for every switching process.

Figure 3A:
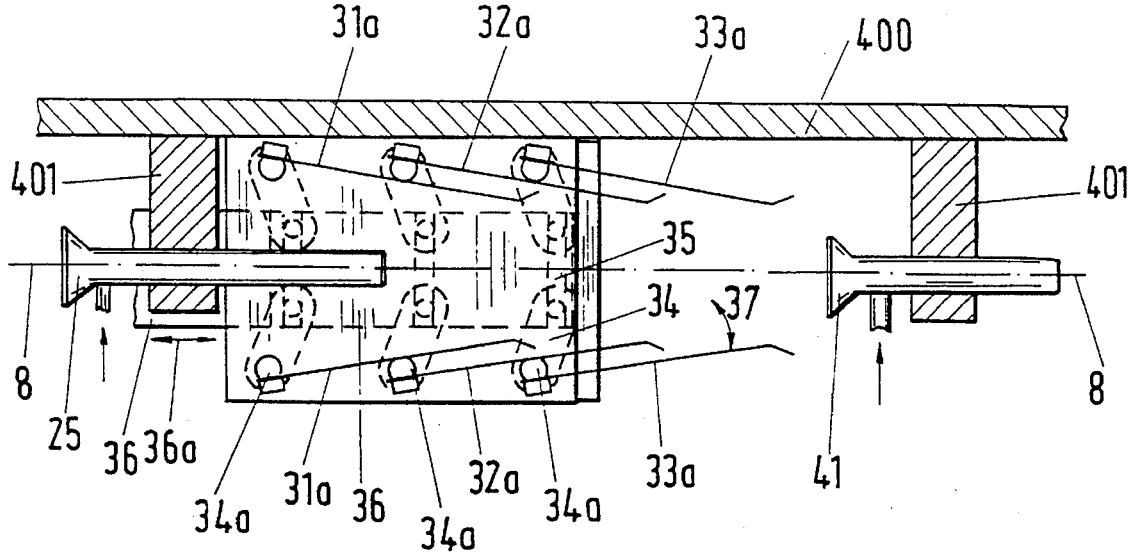
Figure 3B:
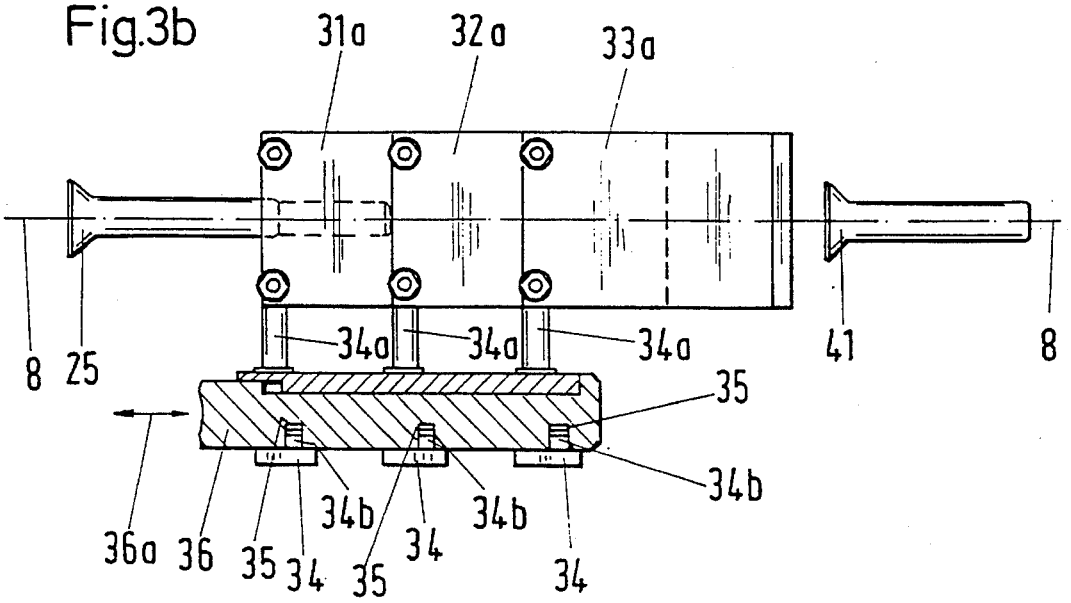

FIG. 3*a* shows a plan view of the yarn brake 3. The suction nozzle 25 and insertion nozzle 41 held by the carrier elements 400, 401 are arranged in an insertion axis 8. On either side of the insertion axis 8, areal brake elements 31*a*, 32*a*, 33*a* are arranged which are mobile in the pivot direction 37 about the pivotable connection element 34*a* so that each of the weft yarns 7 situated between the brake elements 31*a*, 32*a* and 33*a* is contacted by two oppositely disposed pairs of brake elements 31*a*, 32*a* and 33*a* respectively. The brake elements 31*a*, 32*a* and 33*a* exert a clamping and thus a braking action on the weft yarn 7. FIG. 3*b* shows a side view of the brake apparatus. The areas of the brake elements 31*a*, 32*a*, 33*a* can be arranged in any desired direction. In the opened condition 31*a*, the surfaces of the brake elements 31*a*, 32*a*, 33*a* allow the fluid flow between the suction nozzle 25 and the insertion nozzle 41 to be influenced in such a way that the weft yarn 7 is inserted unproblematically into the opening of the insertion nozzle 41. In the closed state 31*a*, two pairs of brake element 31*a*, 32*a*, 33*a* each counteract in such a manner that the region which clamps the weft yarn 7 forms a line along which the clamped weft yarn 7 can move. The brake apparatus 3 has a carriage 36 with grooves 35, wherein pivotable connection elements 34 with lobes 34*b* engage into the grooves 35 so that, when the carriage 36 is moved in the movement direction 36*a*, the brake elements are movable via the pivotable connection elements 34*a* together with the pivotable connection elements 34 connected thereto.

An advantage of the present embodiment of the yarn brake 3 is that it influences and steers the direction of the fluid flow in the opened state. A further advantage is that the region which clamps the weft yarn 7 forms a line which extends approximately through the insertion axis 8. Each pair of brake elements 31*a*, 32*a*, 33*a* forms a clamping region so that a plurality of clamping regions can be arranged one after another in the weft insertion direction. A weft yarn 7 pulled off from a spool can behave highly unstably in the region of the supply unit 2 or the yarn brake 3, for example as a result of the speed with which it was pulled off. A linearly shaped braking region and in particular a plurality of linearly shaped braking regions arranged one after another in the weft insertion direction are suitable for passivating the line or path of the weft yarn 7. The yarn brake 3 tightens the yarn 7 on the supply unit 2 and thus achieves a uniform tensioning on the supply unit.

FIG. 4 shows the weft yarn insertion into a series shed weaving machine 102. Four weft yarns 71, 72, 73 74 are conveyed from four supply units 2 and four metering apparatuses 1 into the weft yarn distribution apparatus 9. The weft yarn distribution apparatus 9 distributes the weft yarns delivered to it into those sheds of the weaving rotor 100 which are currently open, the weft yarns being inserted into the rotating weaving rotor 100 via stationary fluid nozzles 91, 92, 93, 94. At the weft-insertion-side end 100*a* of the weaving rotor 100, a sensor 46*d* monitors the insertion of the weft yarn 74 into the weaving rotor 100. The weft yarns 71, 72 and 73 have been inserted into the weaving rotor 100 one after the other in sequence of increasing height and are thus correspondingly inserted more or less completely towards the weft-arrival-side end 100*b* of the weaving rotor 100. Simultaneous to the weft insertion, the weaving rotor 100 moves in the movement direction 101 so that the weft yarns being inserted are simultaneously moved towards the weft yarn scissors 51 or the yarn clamp 37. In the position of the weaving rotor 100 shown, the weft yarn 71 is completely inserted in the weaving rotor 100, this fact being recognized by the sensor 46*c*. The weft yarn 71 is cut at the weft insertion side by the yarn scissors 51 and is held by the yarn clamp 37. The new yarn tip produced thereby is then steered through the weft yarn distribution apparatus 9 to a further nozzle (not shown) and guided into the shed following thereafter, where following is used in the sense that it follows after the shed into which the weft yarn 74 is inserted. Sensors 46*e* can be positioned along the shed in order to monitor the weft yarn 7 lying in the shed.

The method for automatically remedying irregularities which occur during weft yarn insertion into a series shed weaving machine is described in FIGS. 5*a* to 5*c* and FIGS. 6*a* to 6*d* in terms of the operational steps performed. A microprocessor is used for controlling the sequence of the operational steps, for controlling the actuators and for analysing the sensor signals, the microprocessor having access to RAM, ROM and an input/output device. The operational steps are described in more detail with the embodiment of FIG. 1*a*.

The following occurrences are included within the meaning of an irregularity which occurs during weft yarn insertion which is to be remedied:

An interruption of the supply of weft yarn 7 between a supply unit 2 and a conveyor apparatus 4 of the metering apparatus 1. An interruption of the weft yarn 7 can result from a weft yarn breakage, from an empty spool (which requires a spool change), or from a change of yarn.

An incomplete insertion of the weft yarn 7 into a shed of the weaving rotor.

A prolonged dwell of a weft yarn 7 in a shed when the weaving rotor is stationary while the weft yarn 7 is stretched out by a fluid. In this case the tip of the weft yarn can become damaged, e.g. frayed.

All the irregularities mentioned have the result that the weft yarn 7 cannot be inserted into the shed in the desired manner. This results in imperfections in the cloth if the irregularity is not remedied in time.

Figure 5A:
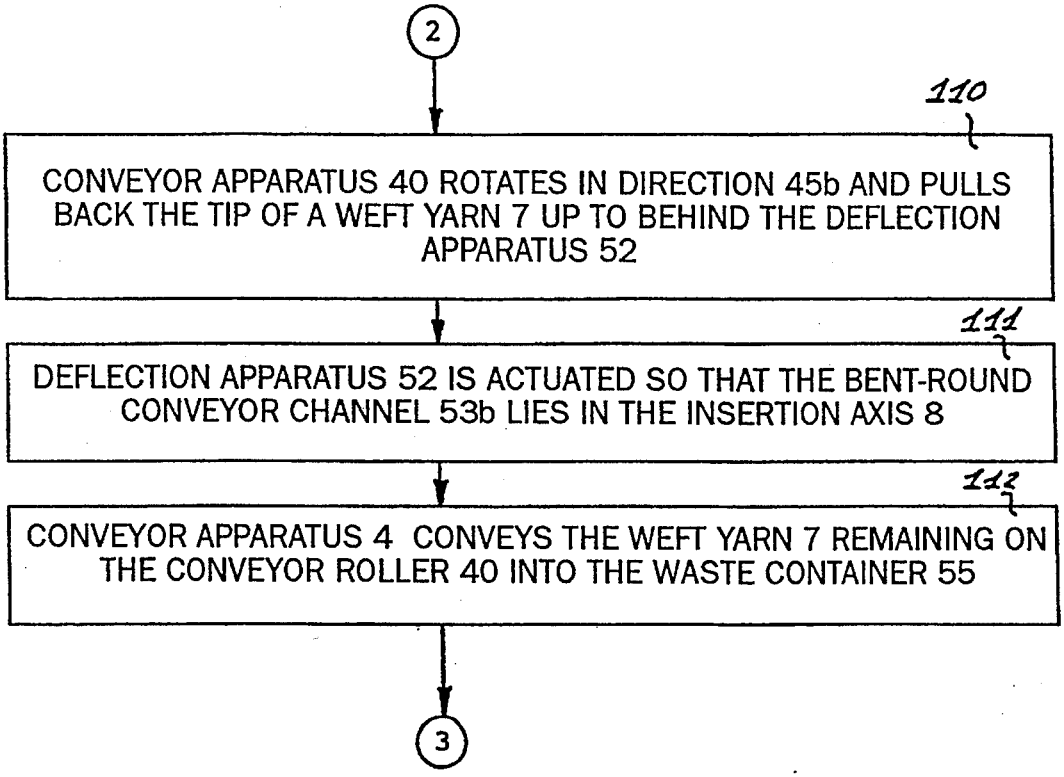

FIG. 5*a* shows a part step of the method of the invention which transports the weft yarn which is stored or situated on the conveyor apparatus 40 to the waste container 55. This part step is, for example, activated when the length of yarn stored on the conveyor apparatus 40 falls below a predetermined value which occurs when a yarn breaks or when the end of a yarn spool is reached. In operational step 110, the conveyor apparatus 40 is rotated in the direction 45*g* and the tip of the weft yarn 7 is pulled back up to behind the deflection apparatus 52. In the subsequent operational step 111, the deflection apparatus 52 is actuated so that the bent-round conveyor channel 53*b* is placed in the insertion axis. In the operational step 112, a part of or all of the weft yarn 7 situated on the conveyor roller 40 is transported to the waste container 55.

Figure 5B:
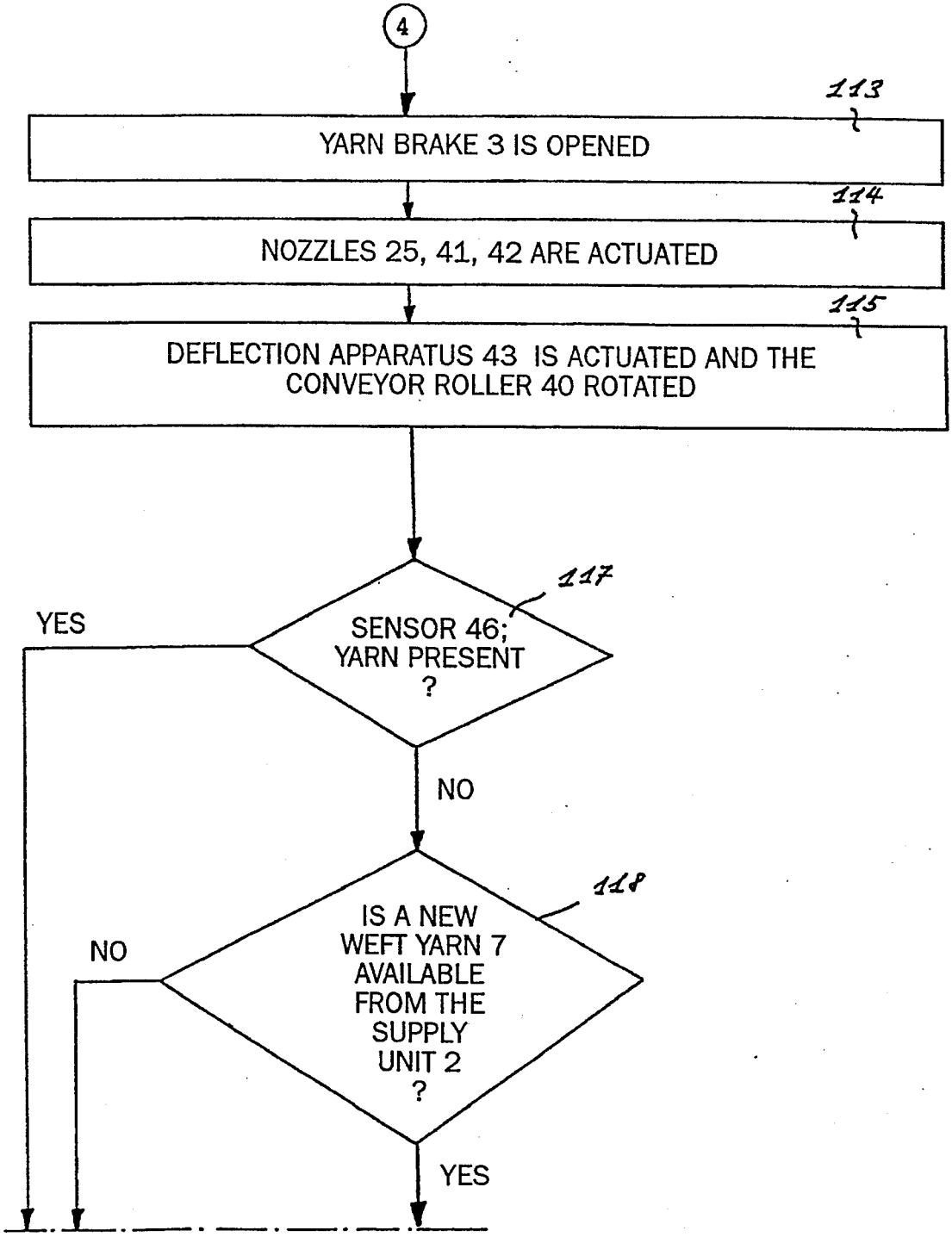
Figure 5C:
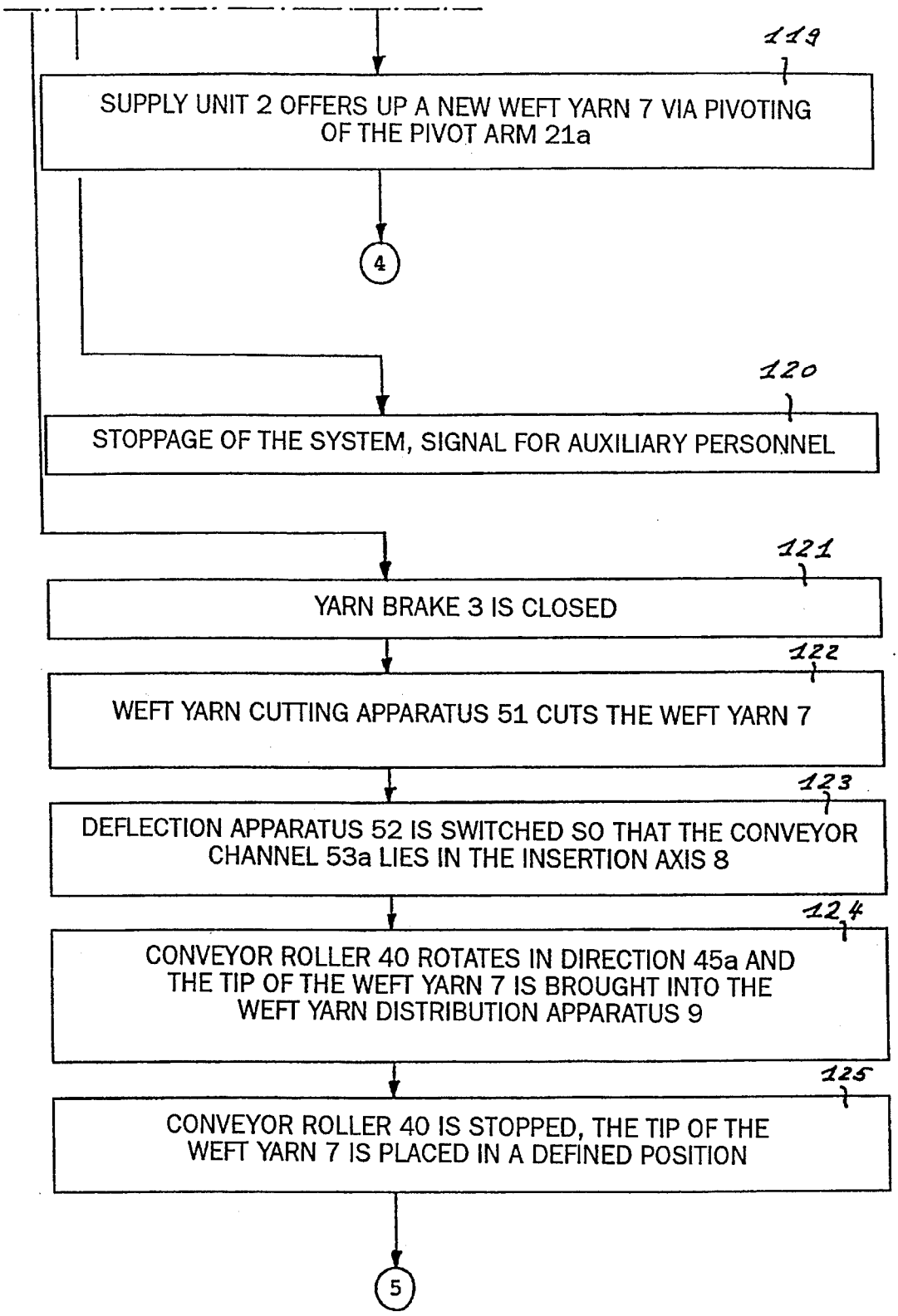

FIGS. 5*b* and 5*c* show a part step for the automatic insertion of a weft yarn 7 into the metering apparatus 1 and for the placement of the weft yarn into the weft preparation unit 6 and into the weft yarn distribution apparatus 9 of the series shed weaving machine. Normally, no weft yarn 7 is present in the metering apparatus 1 before the start of this operational step. In operational step 113, the yarn brake 3 is opened. In operational step 114 the nozzles 25, 41 and 42 are actuated and, consequently, a weft yarn 7 is inserted along the insertion axis 8 (assuming that a weft yarn 7 is present in the nozzle 25). If a weft yarn breakage occurs between the nozzle 25 and the nozzle 41, the weft yarn tip will be in the region of the nozzle 25. In operational step 115, the guide apparatus 53 is pivoted out into the position 43*d* and the conveyor roller 40 is rotated in the rotational direction 45*a*. If a weft yarn 7 is present in the weft yarn conveyor apparatus 4, this is caught by a catcher nose 49 and guided onto the support surface of the conveyor roller 40 via the rotational movement of the conveyor roller 40 so that with each rotation of the conveyor roller 40 one additional winding of the weft yarn 7 is stored on the conveyor roller 40. The guide apparatus 43 is then pivoted once more into the basis position 43*e*.

With operational step 117, it is tested whether a weft yarn 7 is present on the conveyor roller 40. If no weft yarn is present, the operational step 118 checks whether a new weft yarn 7 is available for placement. If this is not the case, the system is closed down in the operational step 120 and auxiliary personnel are requested so that the irregularity can be remedied manually. Otherwise a new weft yarn 7 is offered up with the operational step 119 by pivoting the pivot arm 21*a* and is inserted into the metering apparatus 1 starting with the operational step 113.

In operational step 121, the yarn brake 3 is closed. In step 122, the weft yarn 7 is cut by the weft yarn cutting apparatus 51 thus producing a new yarn tip. In step 123 the deflection apparatus 52 is switched so that the weft yarn 7 can be conveyed into the subsequent weft preparation unit 6. In step 124 the conveyor roller 40 is rotated in the rotational direction 45*a* until, in step 125, the tip of the weft yarn 7 is placed in a defined position in the weft yarn distribution apparatus 9.

Figure 6A:
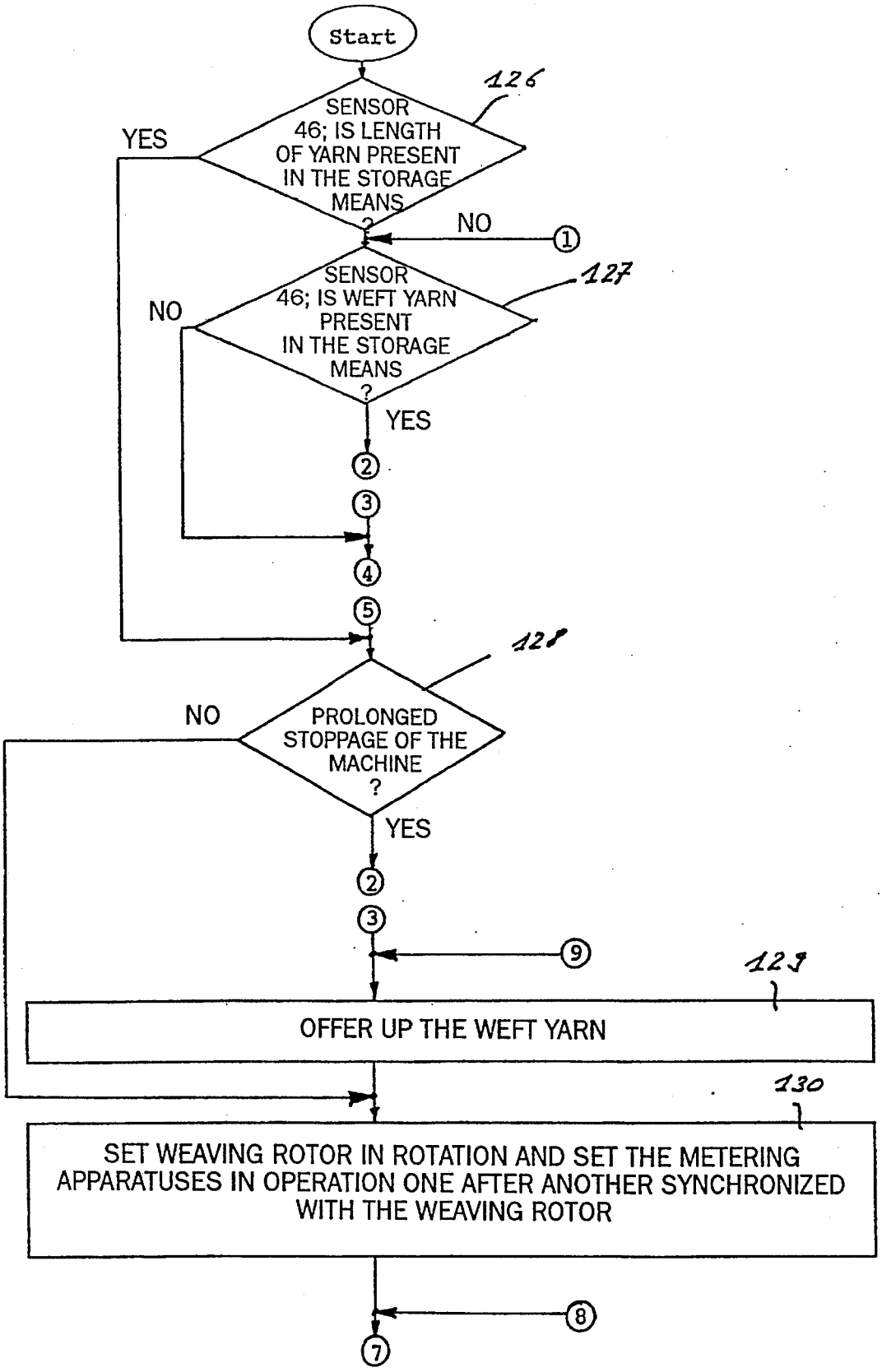

In FIG. 6*a*, a method is shown for starting up a series shed weaving machine from standstill. With operational step 126, it is tested whether a prespecified length of yarn is stored on the conveyor roller 40. If this is not the case, it is checked with operational step 127 whether a weft yarn is present on the conveyor roller 40. If this is the case, the weft yarn 7 situated on the conveyor roller 40 is removed and a new weft yarn 7 brought onto the conveyor roller 40. With the operational step 128 the duration of the down time of the machine is determined. A weft yarn which remains for a prolonged period in the shed of a series shed weaving machine and which, in particular, has been continuously held extended by a fluid may well be damaged. In particular, the tip of the weft yarn can fray so that it is no longer possible to fully insert the weft yarn 7. If the duration of the downtime exceeds a prespecified duration, the operational steps of FIG. 5*a* is carried out whereby the weft yarn 7 is pulled out of the shed and stored temporarily on the conveyor roller 40. A part of the stored weft yarn 7 is then passed into the waste container 55. The weft yarn is then offered up once again by the operational step 129. This step involves cutting the weft yarn by the cutting apparatus 51, thereby creating a new weft yarn tip, and switching the deflection apparatus 52 on placement of the weft yarn 7 into a defined position of the weft yarn distribution apparatus 9.

As soon as all the weft yarns 7 are in place, the weaving rotor of the series shed weaving machine is set into rotation with operational step 130 and the individual metering apparatuses 1 are set into operation one after another in synchronization with the movement of the weaving rotor so that weft yarn insertion into the sheds of the weaving rotor takes place. The points "7" and "8" in the flow diagram of FIG. 6*a* form a delay loop which can be exited as soon as a sensor detects an irregularity or when operating personnel stop the machine.

Figure 6B:
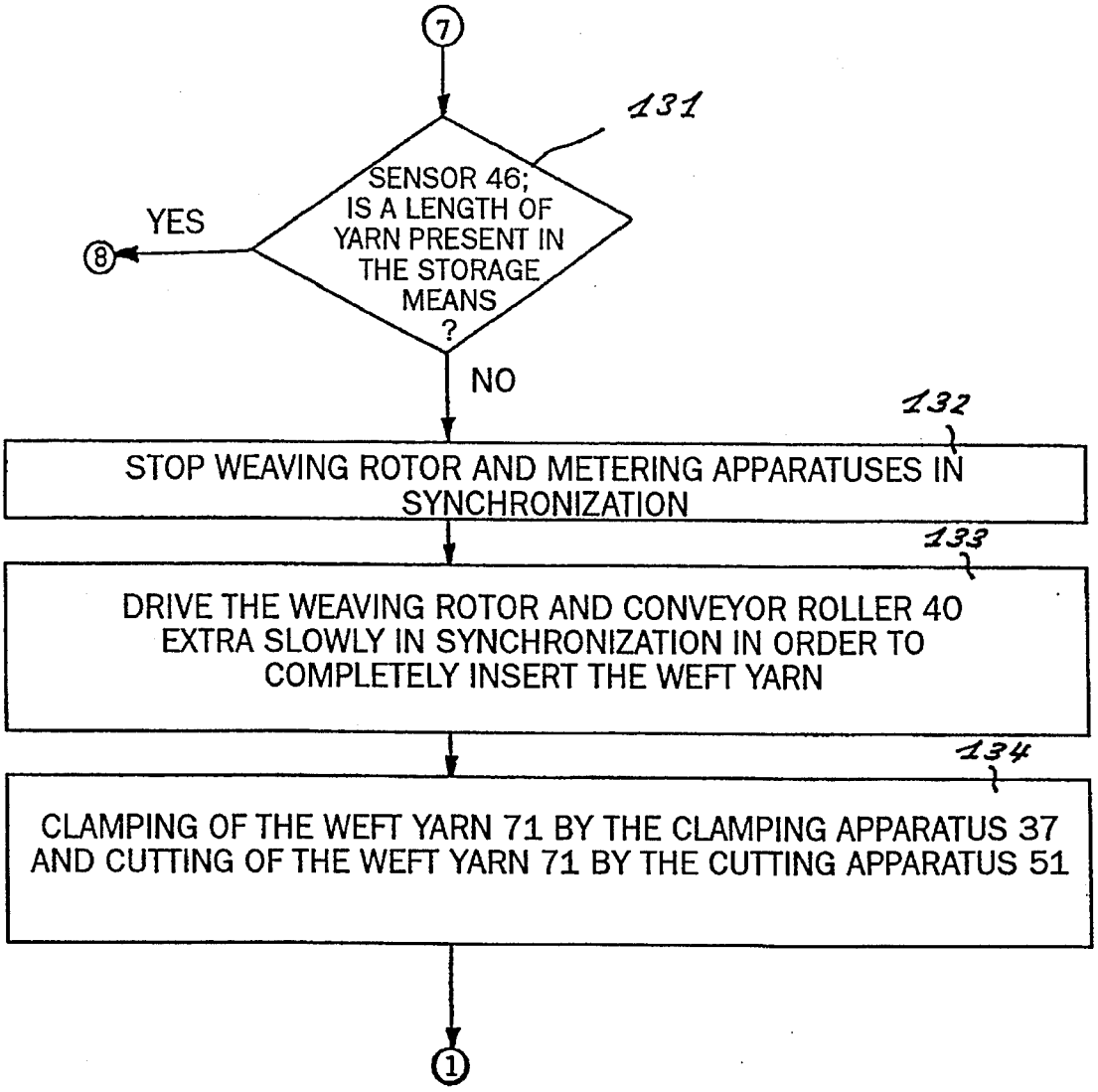

In FIG. 6*b*, operational step 131 detects the length of yarn stored via the sensor 46. If the length of yarn stored has fallen below a prespecified value, it is concluded that a weft yarn breakage has occurred or that the end of a spool has been reached. With the operational step 132, the weaving rotor and the metering apparatus are stopped in a mutually synchronized manner. Subsequently, in operational step 133, the weaving rotor and the conveyor roller associated with the broken weft yarn are driven extra slowly (crept) in synchronization until the weft yarn concerned is fully inserted. Then, with the operational step 134, the weft yarn is clamped by the clamping apparatus 37 and cut by the cutting apparatus 51. Point "1" is then jumped to and new weft yarn offered up.

Figure 6C:
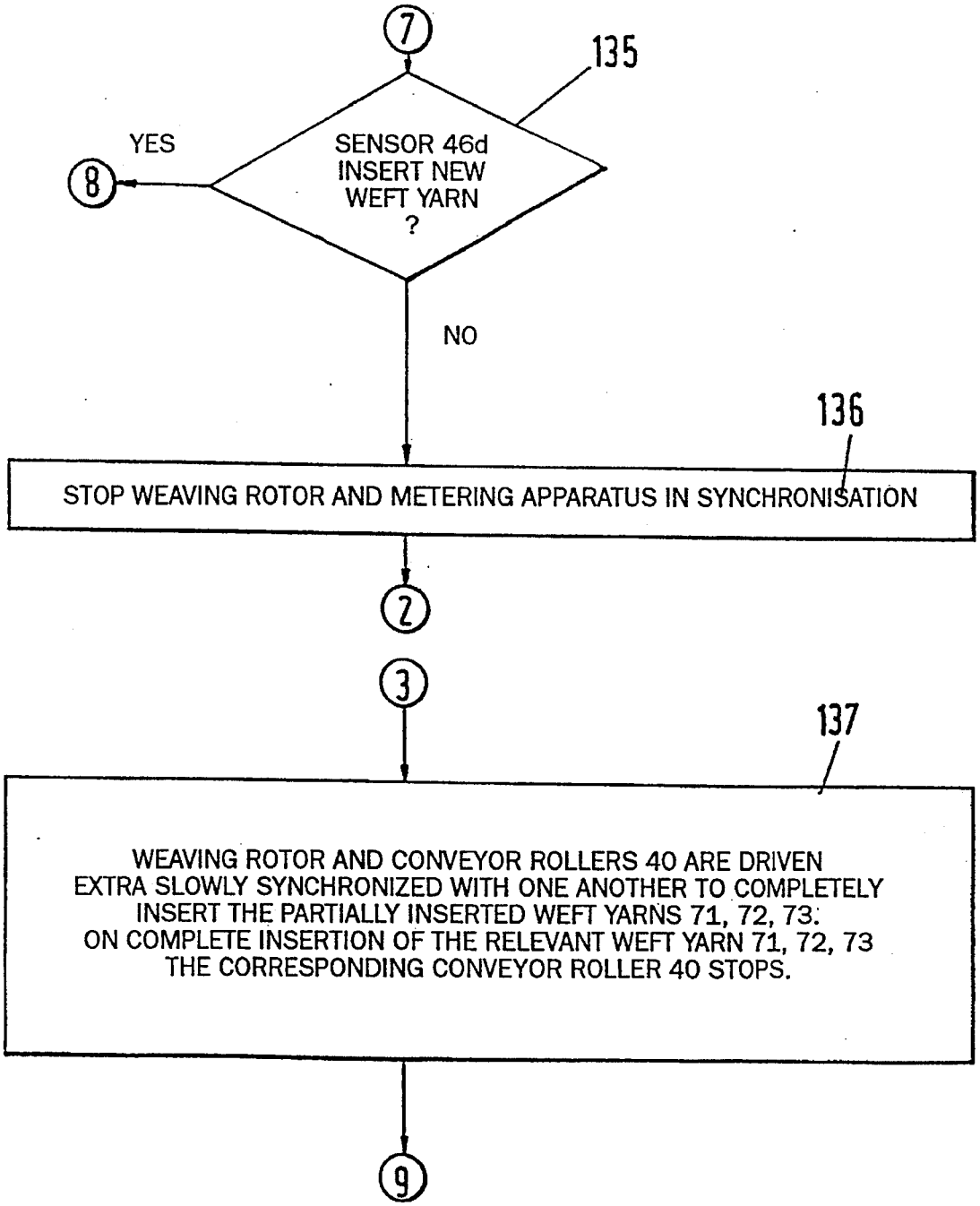

The operational step 135 of FIG. 6*c* monitors the entry of a new weft yarn 74 into the weaving rotor 100 with a sensor 46*d*. If no new weft yarn insertions occur, the weaving rotor and the metering apparatus 1 are stopped in synchronization in operational step 136. The weft yarn is then pulled back by the conveyor roller 40 and disposed of. The weft yarns 71, 72, 73 which lie partially inserted in the shed are then inserted fully in operational step 137 and the weaving rotor 100 is stopped. From there, point "9" is jumped to and the weft yarn is offered up once again.

Figure 6D:
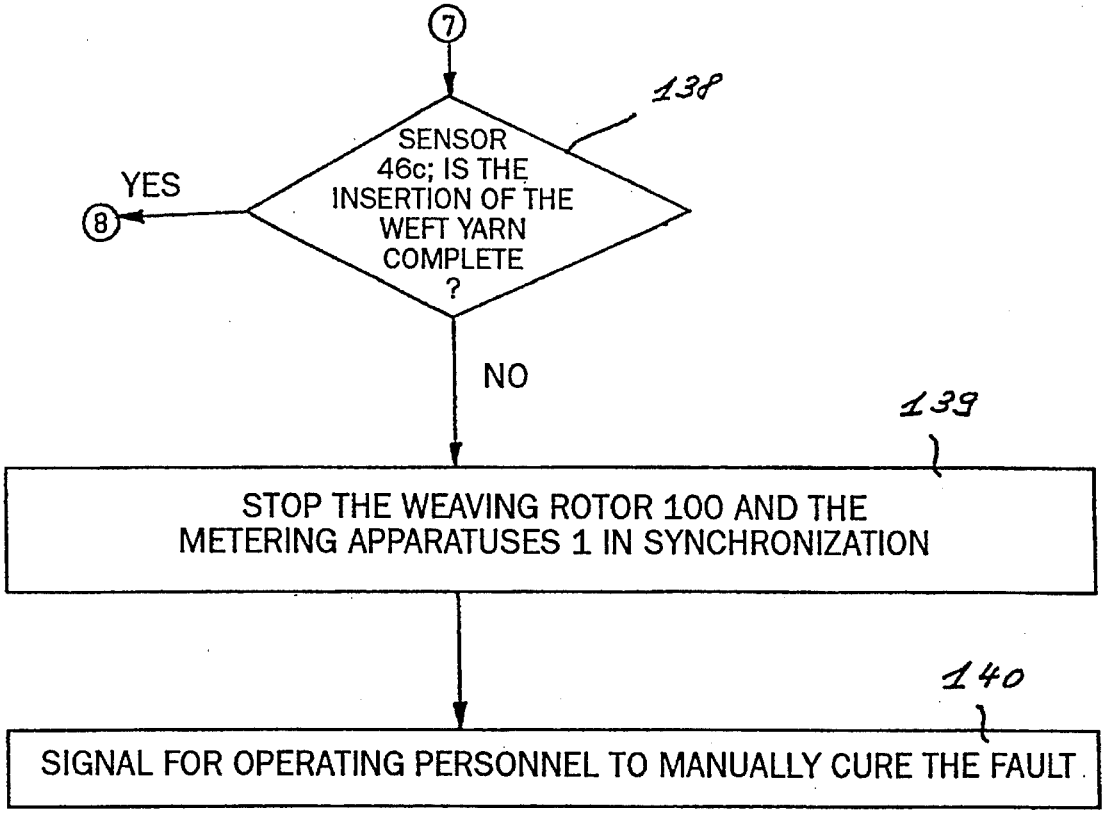

In operational step 138 of FIG. 6*d*, the complete insertion of a weft yarn is monitored by the sensor 46*c* and, in some cases, by further sensors 46*e* distributed along a shed. If it is established that the weft yarn does not reach to the sensor 46*c*, the weaving rotor 100 and the metering apparatus 1 are stopped in synchronization in operational step 139 and, in operational step 140, a signal is activated to indicate to the operating staff that they should remedy the irregularity manually. If the sensor 46*c* detects the absence of a weft yarn, this means that the weft yarn has already been cut on the insertion side so that it is no longer possible to pull it back to the metering apparatus. If additional sensors 46 are installed in the shed, an irregularity which occurs during insertion into the shed can be detected before the weft yarn is cut. Although this situation is not shown in the flow diagram, it is clear that in this situation the weft yarn is automatically disposed of and a new weft yarn can then be offered up.

We claim:

1. An apparatus for correcting irregularities which occur during the insertion of a weft yarn into a weaving rotor of a series shed weaving machine, the series shed weaving machine having a loom width and a weft preparation unit for preparing the weft yarn to enter the weaving rotor, the apparatus comprising:

a separation and deflection apparatus for cutting the weft yarn and conveying the weft yarn in a weft insertion direction;

a conveyor apparatus for determining a speed of conveyance of the weft yarn in the weft insertion direction, the conveyor apparatus comprising a yarn storage assembly for storing a length of weft yarn corresponding to at least one loom width of the series shed weaving machine;

at least one sensor for monitoring the weft yarn; and an actuator for moving the conveyor apparatus in a direction opposite to the weft insertion direction to withdraw the weft yarn from the weft preparation unit.

2. The apparatus of claim 1 wherein the conveyor apparatus comprises a conveyor roller for receiving a plurality of windings of the weft yarn and storing said windings, the conveyor roller being actuable in a rotational direction for conveying the weft yarn in the weft yarn insertion direction.

3. The apparatus of claim 1 wherein the yarn storage assembly is positioned prior to the conveyor apparatus in the weft insertion direction.

4. The apparatus of claim 1 wherein the yarn storage assembly comprises a hollow body and means for loading the hollow body.

5. The apparatus of claim 1 wherein the sensor is aligned with the yarn storage assembly for measuring an amount of weft yarn stored on the yarn storage assembly.

6. The apparatus of claim 1 further comprising a yarn brake for holding the weft yarn with an adjustable force.

7. The apparatus of claim 2 further comprising an insertion nozzle and a capture nozzle defining an insertion axis therebetween for the weft yarn, the conveyor roller being pivotally journalled about a rotational axis and having a jacket surface for carrying the weft yarn, the conveyor roller being positioned below the insertion axis, the insertion axis and the rotational axis forming an acute angle therebetween.

8. The apparatus of claim 7 wherein the jacket surface of the conveyor roller comprises a conically tapering first surface region having a width d and an adjoining second surface region having a width c, the second surface region extending substantially parallel to the rotational axis.

9. The apparatus of claim 7 wherein the jacket surface defines perforations for reducing the mutual contact surface between the conveyor roller and the weft yarn wound thereon.

10. The apparatus of claim 7 wherein the conveyor roller is formed as a cage and has support elements circumferentially spaced about the conveyor roller.

11. The apparatus of claim 1 wherein the separation and deflection apparatus comprises a weft yarn cutting apparatus for cutting the weft yarn and a switching apparatus for supplying the weft yarn to either a weft preparation unit or a storage container.

12. The apparatus of claim 11 wherein the separation and deflection apparatus has an inlet conveyor channel for receiving the weft yarn and at least two outlet conveyor channels for discharging the weft yarn via fluid, the inlet conveyor channel having an outlet opening in communication with inlet openings of the outlet conveyor channels, the separation and deflection apparatus having a drive apparatus for selectively positioning the outlet opening of the inlet conveyor channel into a position opposite one of the inlet openings of the outlet conveyor channels, said outlet opening and the inlet opening of said one of the outlet conveyor channels defining a gap therebetween having a width, the width being selected for receiving the blades into the gap.

13. The apparatus of claim 12 wherein the inlet and outlet conveyor channels are displaceable in the longitudinal direction to adjust the width of the gap.

14. The apparatus of claim 12 wherein the inlet and outlet conveyor channels having different cross-sectional areas than the inlet and outlet openings.

15. The apparatus of claim 12 wherein the cutting apparatus and the switching apparatus are driven by the drive apparatus, the apparatus further comprising a mechanical gearing element for synchronizing the sequence of movements of the conveyor channels and the cutting apparatus during the switching process.

16. The apparatus of claim 11 wherein the weft yarn cutting apparatus comprises a pair of scissors having two cutting surfaces that intersect each other.

17. A method for correcting an irregularity during the insertion of a weft yarn into a shed of a series shed weaving machine of the type having a loom width, the method comprising:

storing a length of the weft yarn in a yarn storage assembly corresponding to at least one loom width of the series shed weaving machine;

conveying the weft yarn towards the shed;

detecting an irregularity in the weft yarn; and after the detecting step, feeding the entire length of weft yarn into the shed.

18. The method of claim 17 wherein the irregularity occurs as a breakage in the weft yarn between a supply unit and a conveyor unit, the method further comprising:

after the detecting step, completing insertion of the length of weft yarn through the weft preparation unit to the shed;

cutting the weft yarn so that a residual weft yarn remains in the weft preparation unit;

stopping the series shed weaving machine;

withdrawing the residual weft yarn from the weft preparation unit; and discharging the residual weft yarn.

19. The method of claim 17 further comprising:

after the detecting step, stopping the series shed weaving machine;

withdrawing the weft yarn from a weft preparation unit; and discharging the weft yarn.

20. The method of claim 17 wherein the irregularity comprises damage to a tip of the weft yarn during downtime of the series shed weaving machine, the method further comprising:

holding the weft yarn within the shed for a prolonged period of time;

withdrawing the weft yarn from a weft preparation unit;

discharging a portion of the length of the weft yarn;

cutting the weft yarn;

starting the series shed weaving machine; and inserting the weft yarn into the shed.

21. The method of claim 18 further comprising measuring the length of weft yarn stored in the yarn storage assembly with a sensor and generating a control signal when the length of weft yarn falls below a predetermined length.

22. In a series shed weaving machine having a loom width, the combination comprising:

a weaving rotor; and an apparatus for correcting irregularities which occur during the insertion of a weft yarn into the weaving rotor, the apparatus comprising:

a separation and deflection apparatus for cutting the weft yarn and conveying the weft yarn to a selectable unit;

at least one sensor for monitoring the weft yarn;

a conveyor apparatus for determining a speed of conveyance of the weft yarn in a weft insertion direction, the conveyor apparatus comprising a yarn storage assembly for storing a length of weft yarn corresponding to at least one loom width of the series shed weaving machine; and an actuator for moving the conveyor apparatus in a direction opposite to the weft insertion direction.

23. An apparatus for correcting irregularities which occur during the insertion of a weft yarn into a weaving rotor of a series shed weaving machine, the series shed weaving machine having a loom width, the apparatus comprising:

a separation and deflection apparatus for cutting the weft yarn and conveying the weft yarn to a selectable unit;

at least one sensor for monitoring the weft yarn;

a conveyor apparatus for determining a speed of conveyance of the weft yarn in a weft insertion direction, the conveyor apparatus comprising a yarn storage assembly for storing a length of weft yarn corresponding to at least one loom width of the series shed weaving machine and a conveyor roller for receiving a plurality of windings of the weft yarn and storing said windings, the conveyor roller being actuable in a rotational direction for conveying the weft yarn in the weft yarn insertion direction;

an actuator for moving the conveyor apparatus in a direction opposite to the weft insertion direction; and an insertion nozzle and a capture nozzle defining an insertion axis therebetween for the weft yarn, the conveyor roller being pivotally journalled about a rotational axis and having a jacket surface for carrying the weft yarn, the conveyor roller being positioned below the insertion axis, the insertion axis and the rotational axis forming an acute angle therebetween.

* * * * *

UNITED STATES PATENT AND TRADEMARK OFFICE

CERTIFICATE OF CORRECTION

PATENT NO. : 5,564,473

DATED : OCTOBER 15, 1996

INVENTOR(S) : URS SCHAICH ET AL.

It is certified that error appears in the above-indentified patent and that said Letters Patent is hereby corrected as shown below:

On the title page, item [73]: Assignee, should read as follows;

SULZER RÜTI AG, Winterthur, Switzerland

Signed and Sealed this

First Day of July, 1997

Bruce Lehman

*Attest:*

BRUCE LEHMAN

*Attesting Officer*

*Commissioner of Patents and Trademarks*